US005408163A

United States Patent [19]

Milili et al.

[11] Patent Number: 5,408,163

[45] Date of Patent: Apr. 18, 1995

[54] SELF CONVERGING WIDE SCREEN COLOR PICTURE TUBE SYSTEM

[75] Inventors: Marc Milili, Puteaux, France; Jeffrey P. Johnson, Lawrenceville, N.J.; Jean-Michel Carrier, Dijon, France

[73] Assignee: Thomson Tubes & Displays, S.A., Paris La Defense, France

[21] Appl. No.: 937,873

[22] PCT Filed: May 10, 1991

[86] PCT No.: PCT/US91/03250

§ 371 Date: Oct. 19, 1992

§ 102(e) Date: Oct. 19, 1992

[30] Foreign Application Priority Data

May 11, 1990 [EP] European Pat. Off. ..... 90401265

[51] Int. Cl.[6] ..... H01J 29/56

[52] U.S. Cl. ..... 315/370; 335/213; 313/413

[58] Field of Search ..... 315/370; 335/213; 313/413

[56] References Cited

U.S. PATENT DOCUMENTS 4,329,671 5/1982 Gross et al. ..... 335/213

4,376,924 3/1983 Gross et al. ..... 335/210

*Primary Examiner*—Theodore M. Blum

*Attorney, Agent, or Firm*—Joseph S. Tripoli; Joseph J. Laks; Daniel E. Sragow

[57] ABSTRACT

A self converging, widescreen color picture tube system includes a widescreen, in-line color picture tube having a funnel, an electron gun assembly (28) for three in-line electron beams located in a neck at one end of the picture tube, and a faceplate with a viewing screen at the other end. The picture tube has a wide aspect ratio. A self converging widescreen deflection yoke (40) for deflecting the electron beams in the wide aspect ratio picture tube includes horizontal and vertical deflection windings. The yoke (40) is located by an initial flare section of the funnel and positioned along the longitudinal axis of the picture tube to make the tube reference line and the yoke deflection plane substantially coincident. To achieve substantial horizontal astigmatism correction at the extremes of the major axis of the wide viewing screen, the horizontal deflection winding is constructed to have a generally pincushion-shaped horizontal deflection field over the effective length of the field. The field is modified from that required of the horizontal deflection field in a comparable self converging narrowscreen yoke. The modification is made in accordance with the differences in centerscreen slope angles and S-spacing.

26 Claims, 18 Drawing Sheets

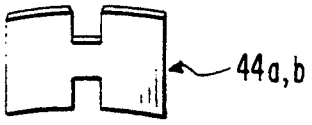
FIG. 8a
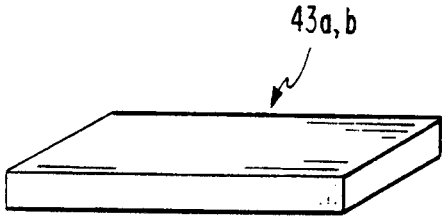
FIG. 8c
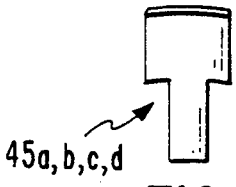
FIG. 8b
FIG. 7
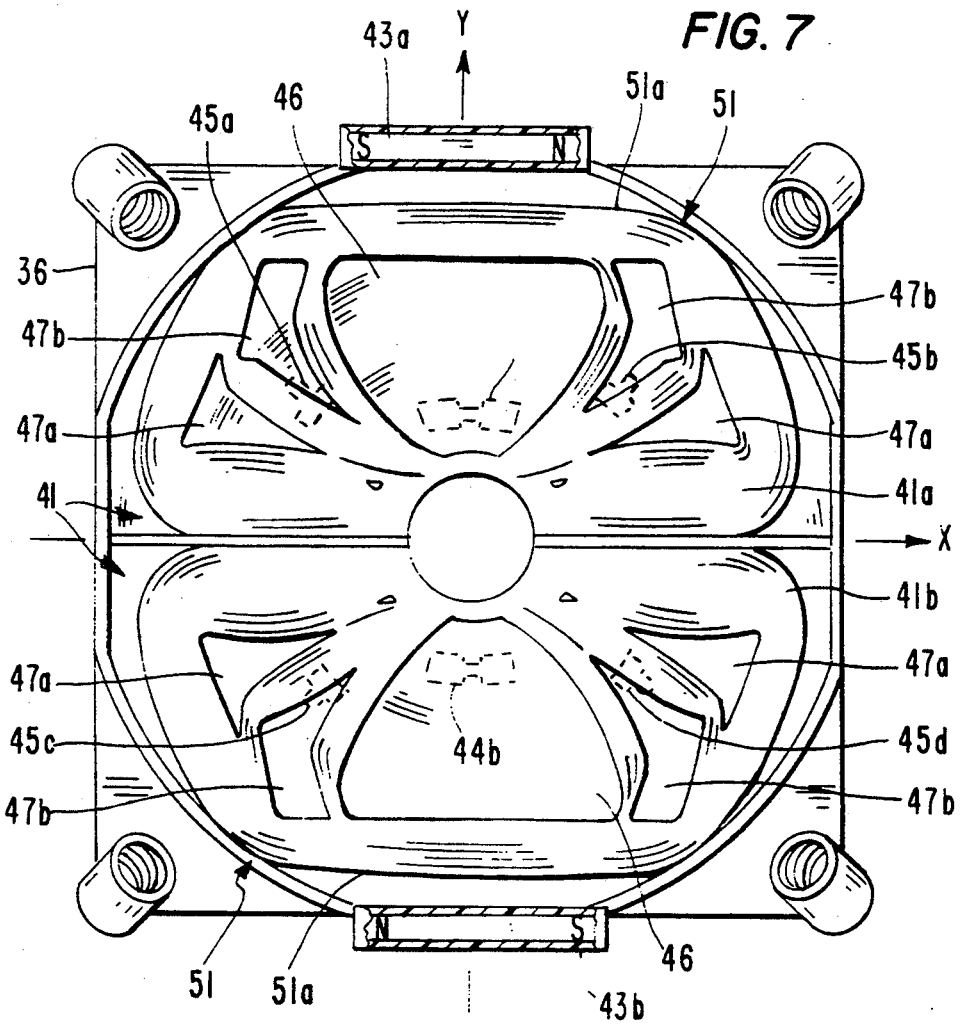

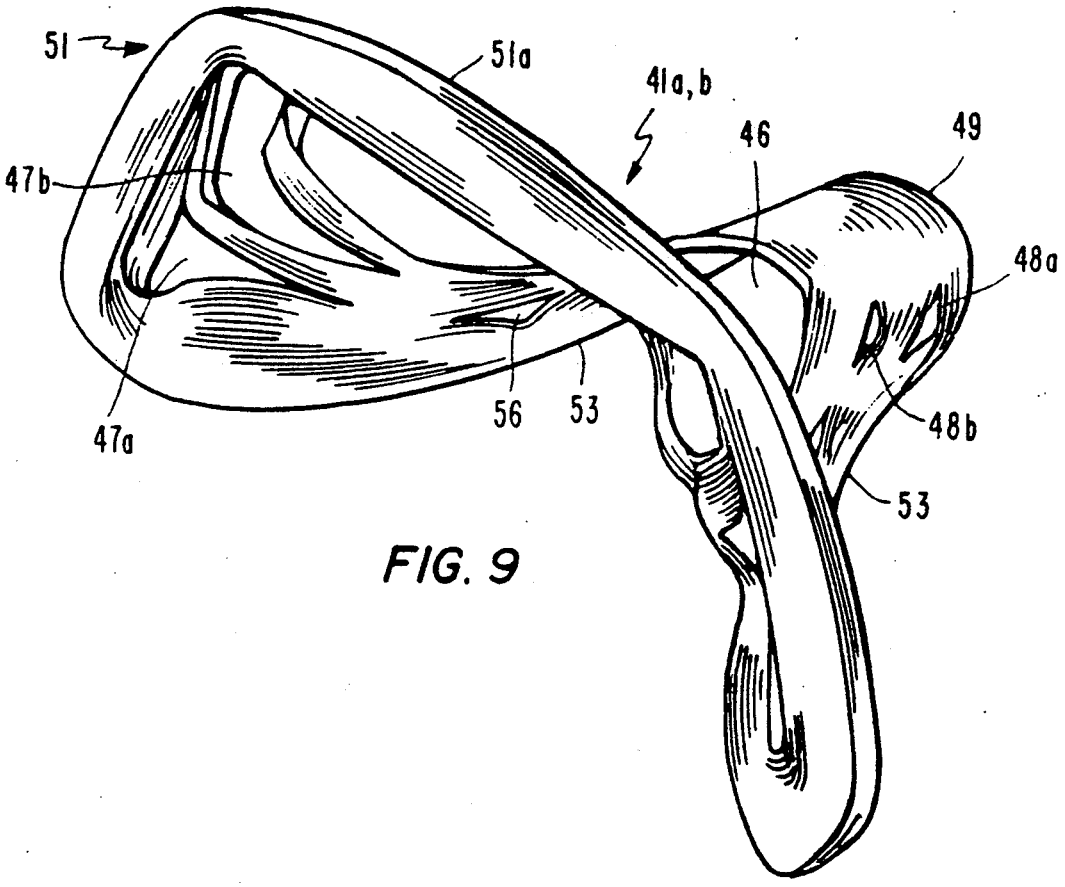
FIG. 9
FIG. 10
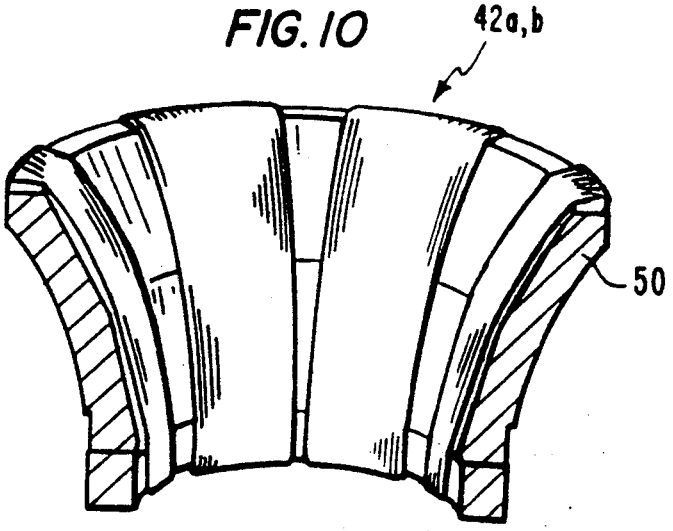

SELF CONVERGING WIDE SCREEN COLOR PICTURE TUBE SYSTEM

This invention relates to a self converging wide screen color picture tube system.

To provide a more pleasing viewing experience, there has recently been developed a family of picture tubes having an aspect ratio of 16×9, where 16 represents the screen dimension in arbitrary units along the horizontal or X-direction, and 9 represents in the same units the distance along the vertical, or Y-direction. FIG. 1 schematically compares a widescreen, 16×9 aspect ratio picture tube viewing screen VSW with a standard narrowscreen, 4×3 aspect ratio viewing screen VSN. For the same diagonal length D of e.g. 86.3 cm (34 V), the wide aspect ratio viewing screen is approximately 9% wider in the X-direction and approximately 10% shorter in the Y-direction than the corresponding narrow aspect ratio viewing screen.

In addition to the wider aspect ratio, other pleasing viewer features include a picture tube with a panel that is nearly rectangular in shape, and with the contour of the panel faceplate as flat as practical, taking into account the overall weight and implosion strength requirements of the picture tube.

FIG. 2 illustrates a front view of a rectangular faceplate 18 of a widescreen, 16×9 aspect ratio color picture tube. Located on the inner surface of faceplate 18 is a line stripe type of color phosphor screen VSW. Associated with rectangular faceplate 18 is a major axis X, a minor axis Y, and diagonals D. Two long sides, L, of faceplate 18 are substantially parallel to the major axis X, and two short sides, S, are substantially parallel to the minor axis Y.

The inside surface of faceplate 18 of FIG. 2 is shown in perspective in FIG. 3 including curved lines 22–26 which follow the inner surface contour of faceplate 18 in directions corresponding to those indicated in FIG. 2. For each one of curved lines 22–26 there is associated an equivalent radius R which corresponds to the radius of a circle that touches the center CW of faceplate 18 and the corresponding extremes of the faceplate at the edges of the viewing screen. The actual contour of the inner surface of faceplate 18 is more complex and is more precisely defined by the equations to be discussed herein.

In FIG. 3, the equivalent radius of curve 22, which follows the major axis, is designated RX, and the equivalent radius of curve 23 which follows the minor axis is designated RY. The equivalent radius of curve 25, which follows the long side of the faceplate, is designated RL, and the equivalent radius of curve 26, which follows the short side, is designated RS. The equivalent radius of curve 24, which follows a faceplate diagonal, is designated RD.

The contour of the inner surface of faceplate 18 is defined by the following polynomial sum equation.

$$ZW = \Sigma i(Ai)(10 \wedge Ji)(X \wedge Ni)(Y \wedge Mi)$$
$$i = 1,2,3, \ldots 7$$

ZW is defined as the distance of a point on the inner surface of faceplate 18 from the sagittal plane tangent to the inner surface at center point CW. Each of X and Y is defined as the distance from center CW in a sagittal plane along a respective one of orthogonal axes having directions corresponding to those of the major and minor axes.

The ZW equation defines a family of aspherical, faceplate contours which can be made relatively flat by proper parameter selection.

For a flat faceplate having a viewing screen diagonal distance DW=86.3 centimeter in the sagittal plane, the coefficients Ai and the exponents Ji, Ni, Mi are given in the following table.

TABLE I

| | | | |
|---|---|---|---|
| A(1) = +2.7548540 | J(1) = −04 | N(1) = 2 | M(1) = 0 |
| A(2) = +3.0213080 | J(2) = −10 | N(2) = 4 | M(2) = 0 |
| A(3) = +4.9051820 | J(3) = −04 | N(3) = 0 | M(3) = 2 |
| A(4) = −2.0299050 | J(4) = −10 | N(4) = 2 | M(4) = 2 |
| A(5) = −6.3074090 | J(5) = −15 | N(5) = 4 | M(5) = 2 |
| A(6) = +9.4301190 | J(6) = −11 | N(6) = 0 | M(6) = 4 |
| A(7) = +5.2725900 | J(7) = −15 | N(7) = 2 | M(7) = 4 |

Heretofore, a deflection yoke for use in a large screen, wide aspect ratio picture tube has been of the nonself converging type, requiring auxiliary coils in the yoke to provide outer beam convergence. The added cost of additional coils and the added complexity of including convergence waveform generators and output stages in the deflection circuitry to drive the yoke, make it desirable to go to a self converging system for deflection in a widescreen picture tube.

A natural inclination of the yoke designer is to use the previously developed self converging yoke design arrangements for 4×3 aspect ratio picture tubes, in order to design a self converging yoke for a wide aspect ratio picture tube. When doing so, however, problems may arise due to inherent differences in critical parameters between a self converging tube-yoke system of a narrow aspect ratio design, and those of a wide aspect ratio design. These differences could readily be overlooked with short product development cycles and under the heavy pressures of product scheduling deadlines.

If these parameters are not adequately taken into account, an iterative design process may take place which attempts to solve problems observed in adopting 4×3 yoke design to a 16×9 system by means of various corrective actions. These corrective actions may introduce still more problems, and so on, needlessly extending the design process.

Some of these corrective actions may involve deflection winding changes such as changes in the horizontal coils. These coils may be of the saddle wound type using winding arbors whose surface contour, pin location, wire travel, etc., depend on parameters needed to generate a self converging horizontal deflection field. To change the winding arbor configuration during an iterative design process could substantially delay this process, if the arbor changes were too severe.

It is therefore advantageous to take into account differences between a wide aspect ratio self converging system and a narrow aspect ratio one, when designing a self converging deflection yoke for use in wide aspect ratio picture tube.

A self converging, widescreen color picture tube system, in acordance with an inventive arrangement, includes a widescreen, in-line color picture tube having a funnel, an electron gun assembly for three in-line electron beams located in a neck at one end of the picture tube, and a faceplate with a viewing screen at the other end. The picture tube has a wide aspect ratio, as referenced against a comparable narrowscreen, in-line color picture tube that has the same viewing screen diagonal length, the same screen contour, and the same horizontal deflection angle, as measured from the corresponding tube reference line between extremes of the major axis, but has a different centerscreen slope angle and electron beam S-spacing.

A self converging widescreen deflection yoke for deflecting the electron beams in the wide aspect ratio picture tube includes horizontal and vertical deflection windings. The yoke is located by an initial flare section of the funnel and positioned along the longitudinal axis of the picture tube to make the tube reference line and the yoke deflection plane substantially coincident.

To achieve substantial horizontal astigmatism correction at the extremes of the major axis of the wide viewing screen, the horizontal deflection winding is constructed to have a generally pincushion-shaped horizontal deflection field over the effective length of the field. The field is modified from that required of the horizontal deflection field in a comparable self converging narrowscreen yoke. The modification is made in accordance with the differences in centerscreen slope angles and S-spacing. This avoids a misconvergence condition from existing at the extremes of the major axis of the wide viewing screen that would otherwise have placed the crossover point of the outer electron beams substantially removed from the surface of the wide viewing screen.

FIG. 1 schematically illustrates the dimensions of a narrowscreen, 4×3 aspect ratio viewing screen and a widescreen, 16×9 aspect ratio viewing screen;

FIG. 7 illustrates a front elevation view of the deflection yoke of FIG. 5;

Figure 5:
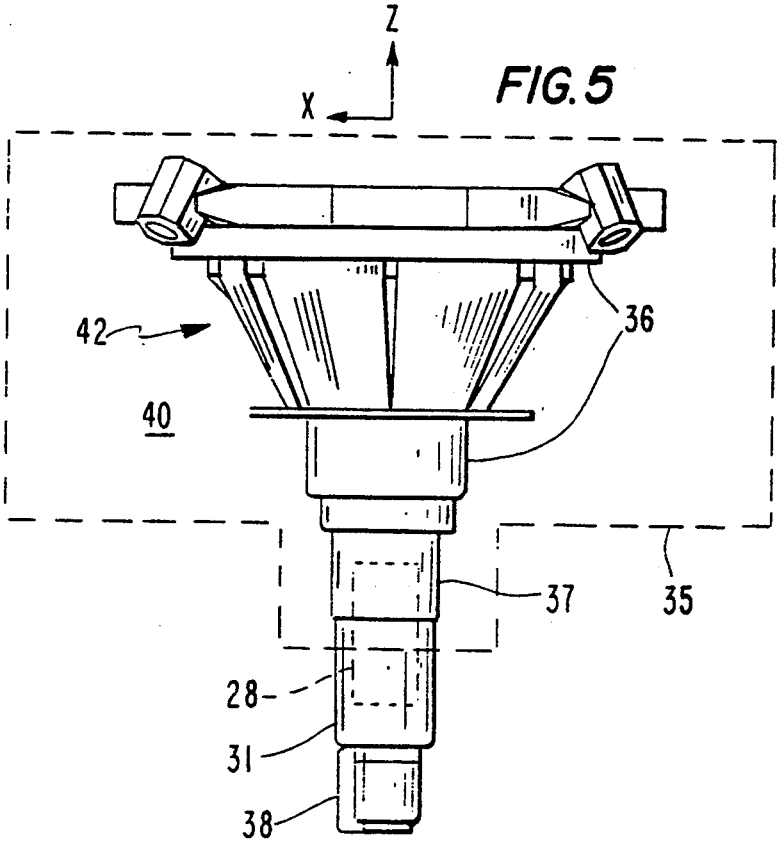
FIG. 5 illustrates in top elevational view a portion of the widescreen picture tube of FIG. 4 with details of a deflection yoke assembly, embodying the invention.
Figure 11A:
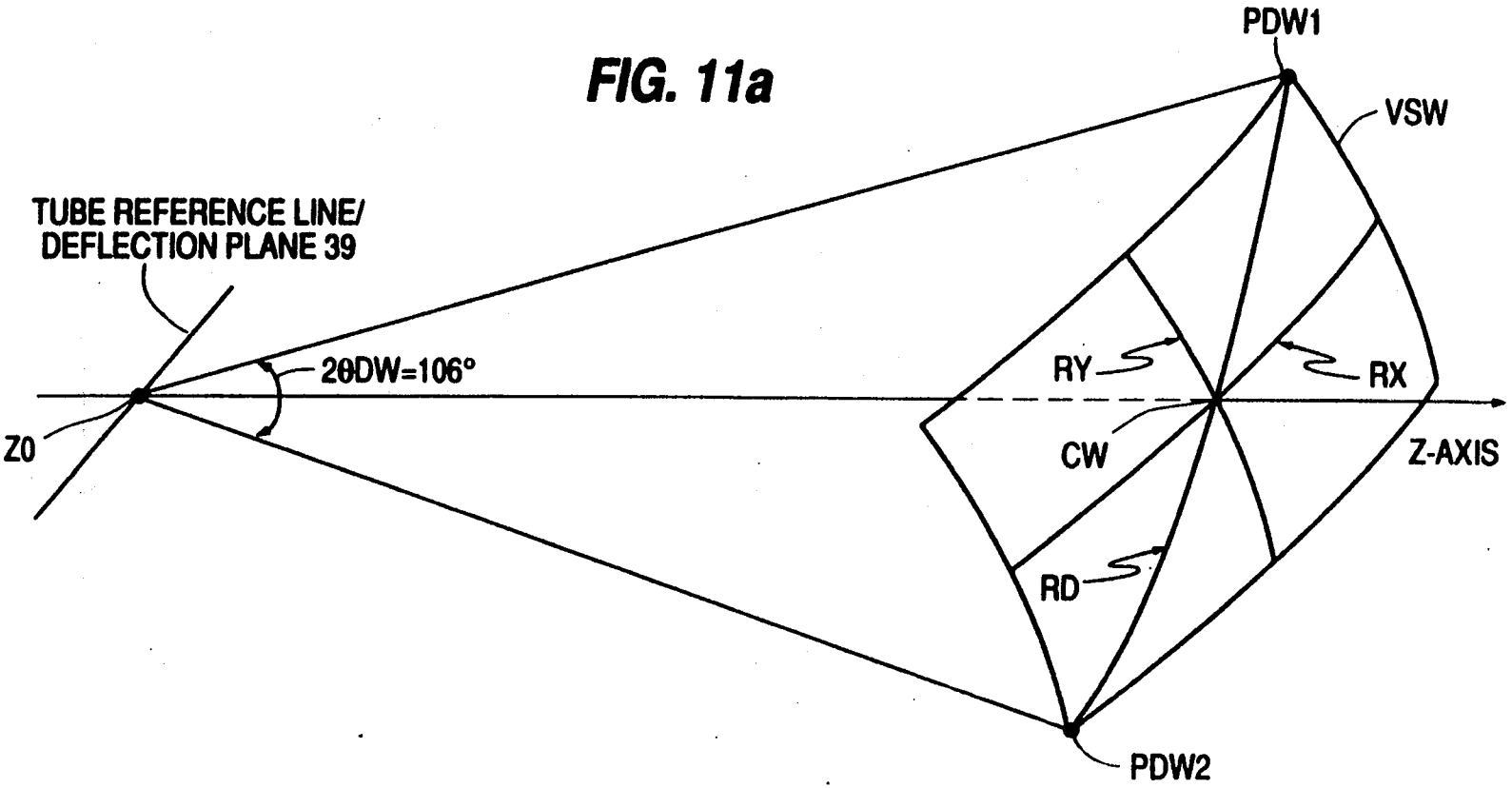
Figure 11B:
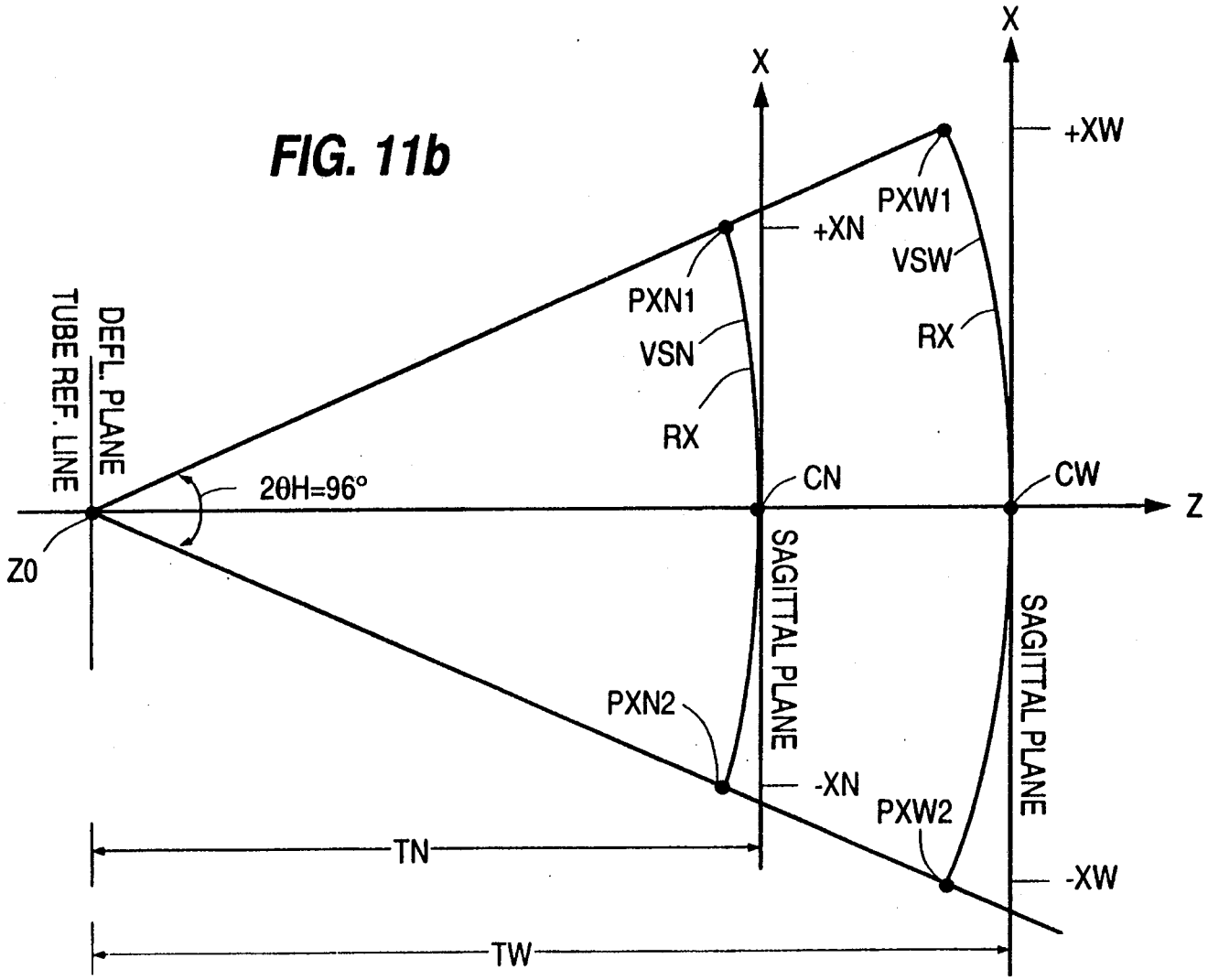
Figure 11C:
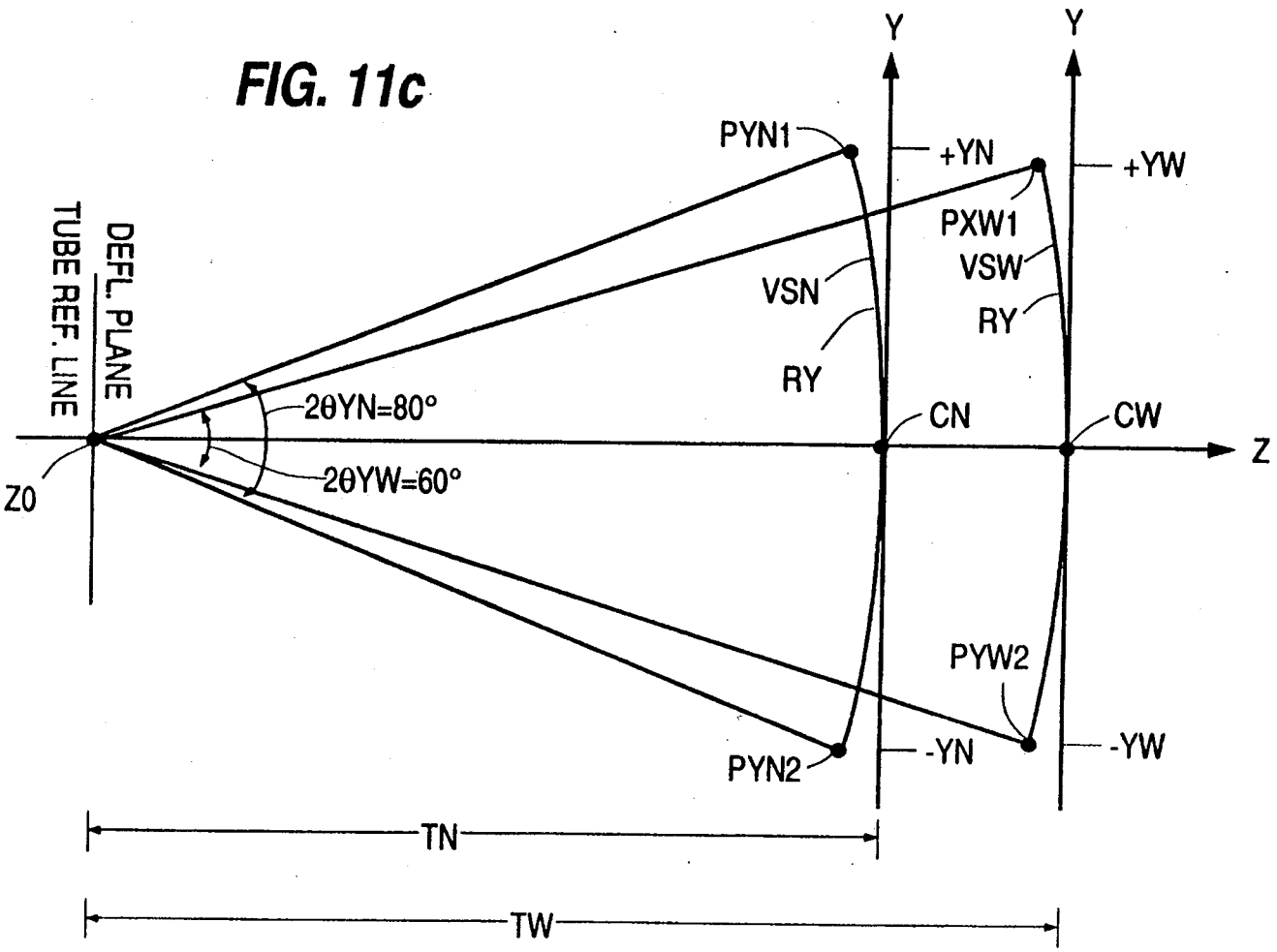
Figure 12:
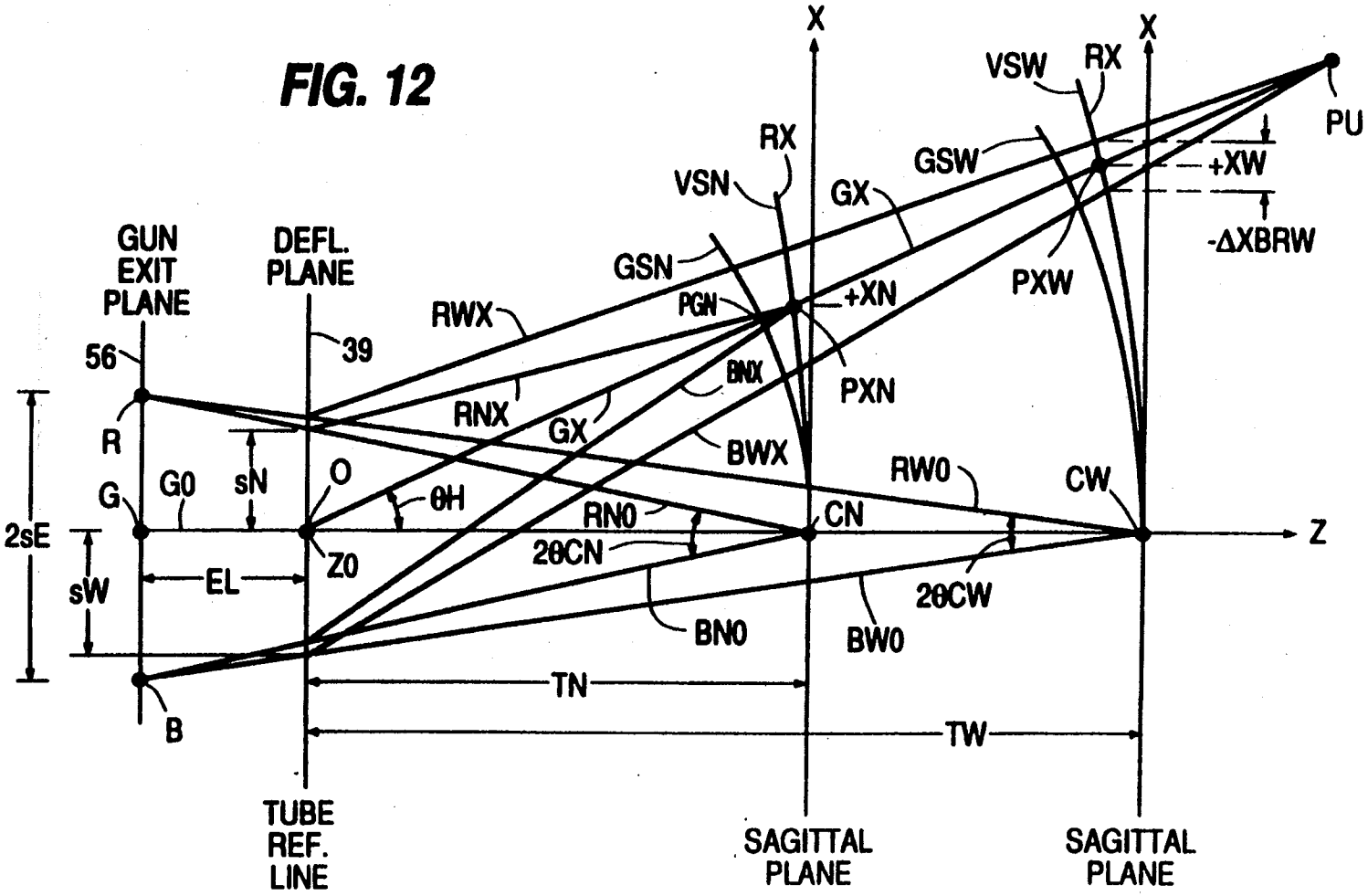
Figure 13:
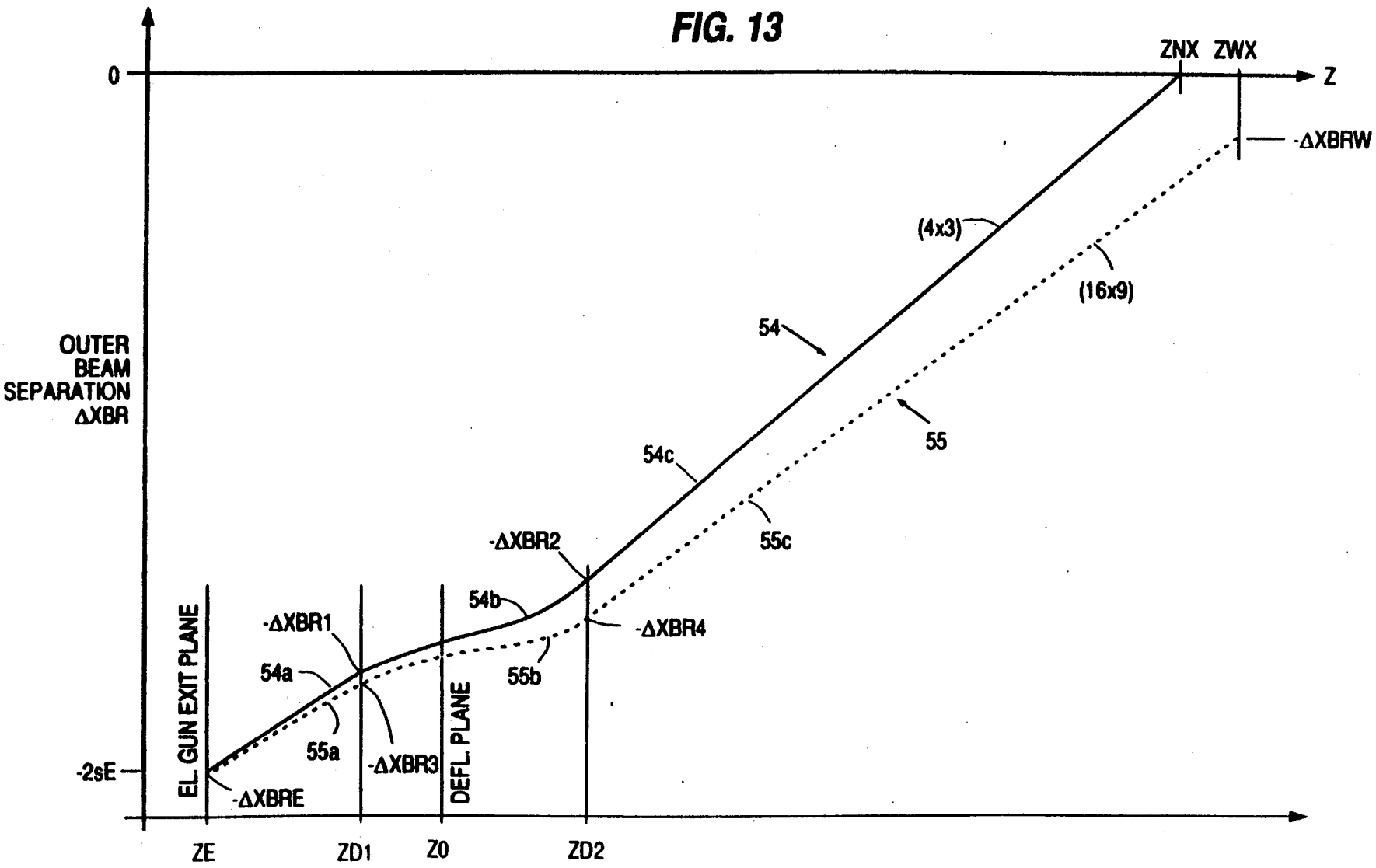
Figure 14:
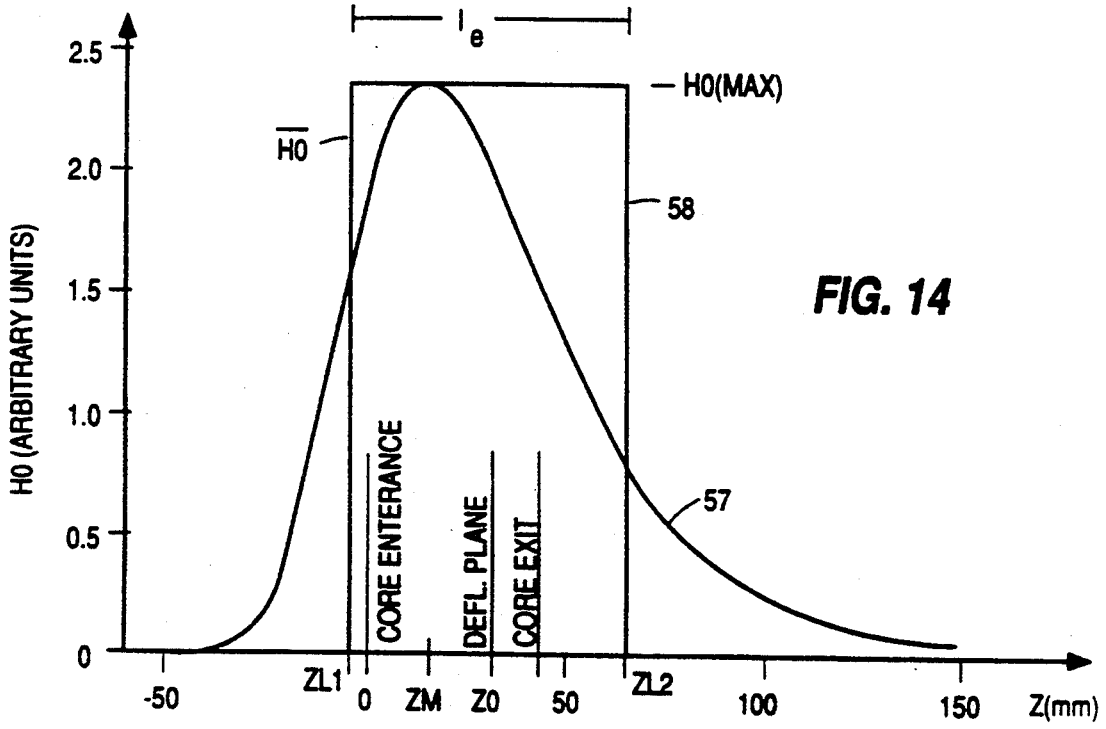
Figure 15:
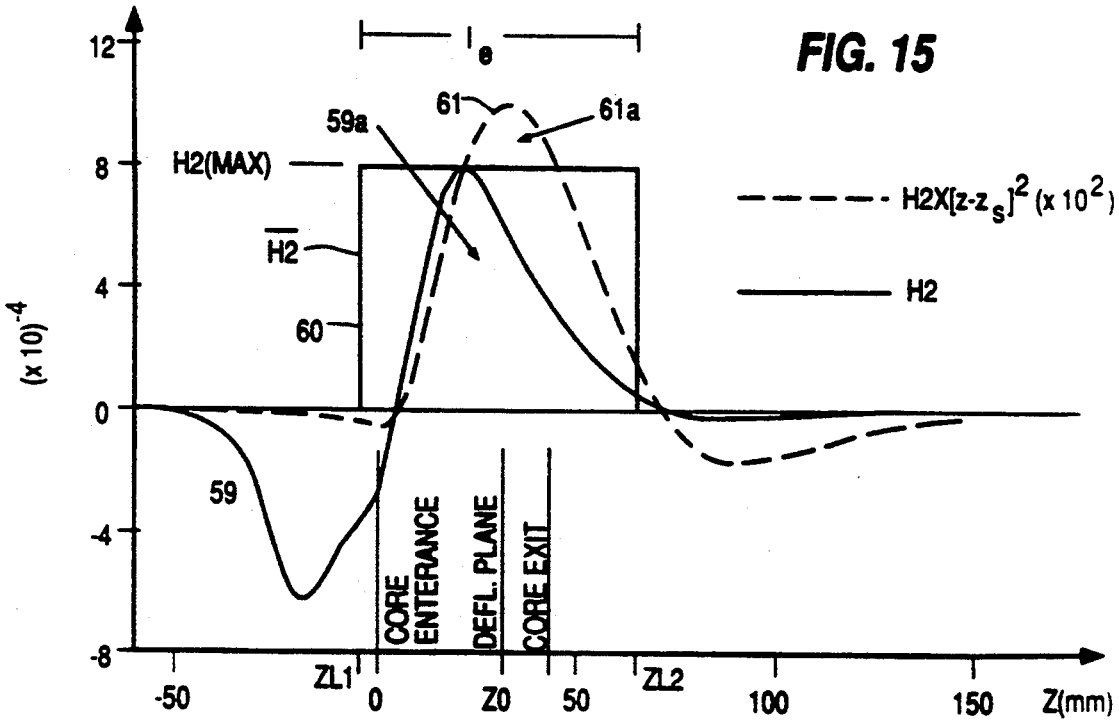
Figure 16:
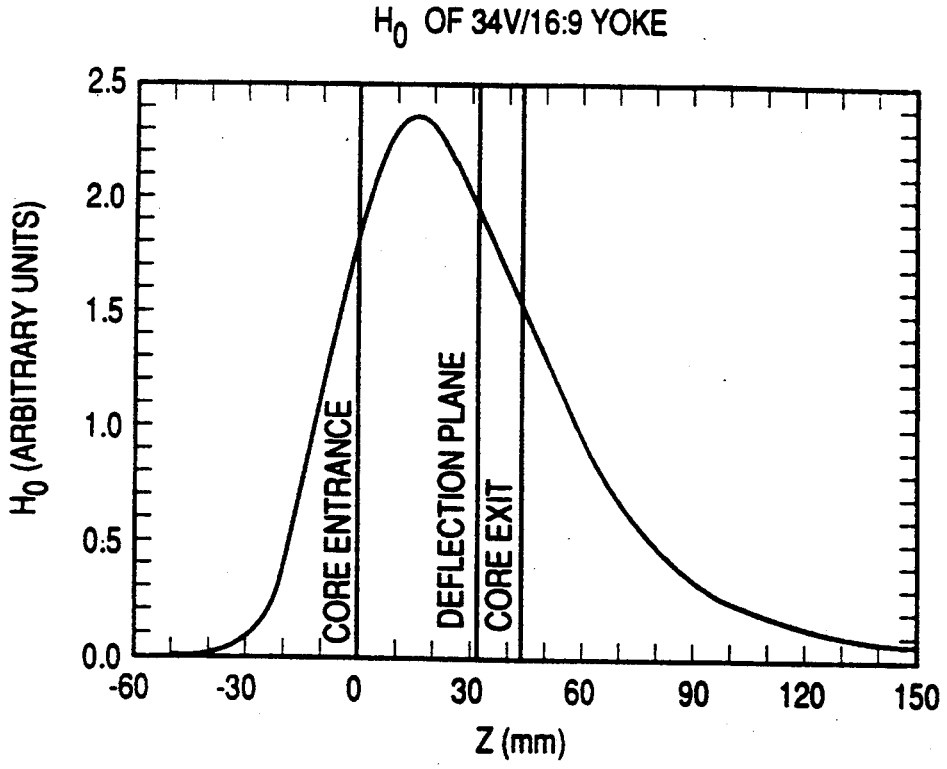
Figure 17:
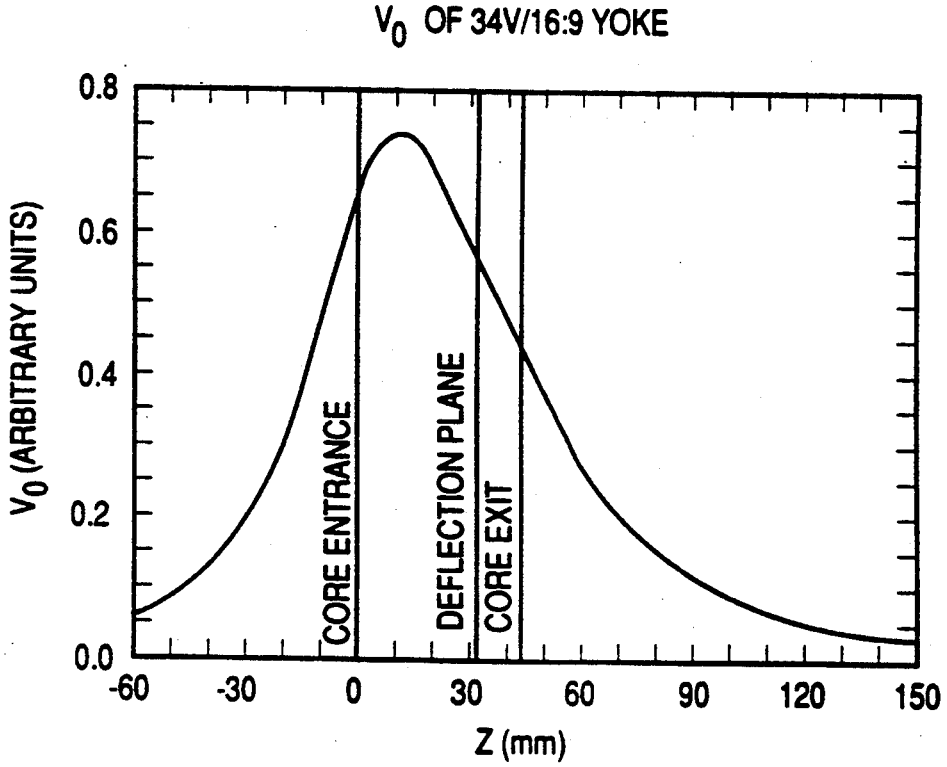
Figure 18:
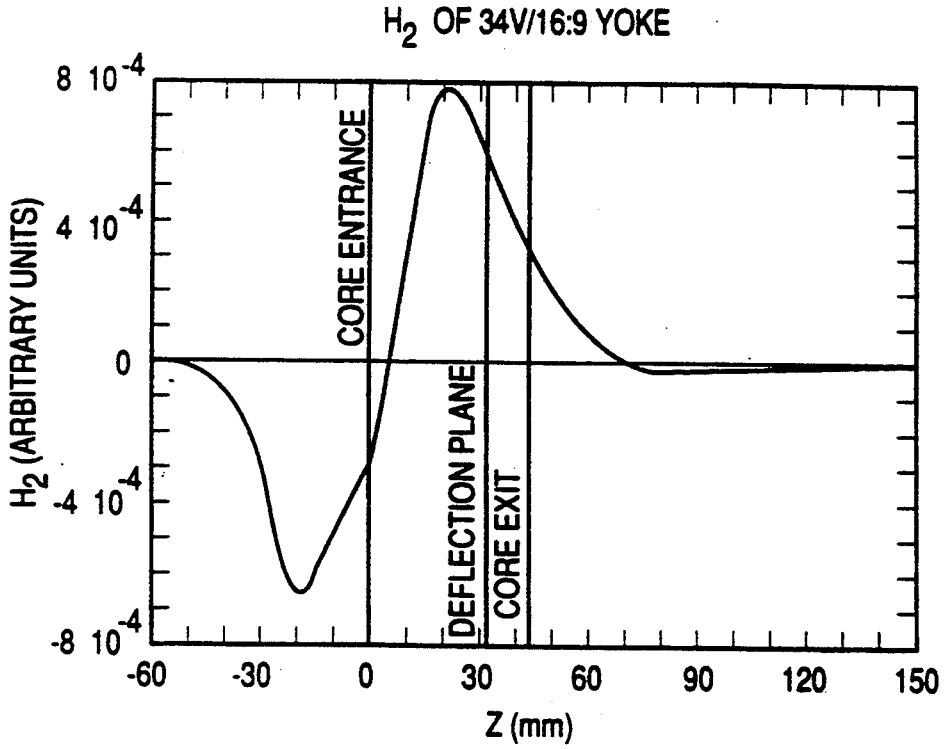
Figure 19:
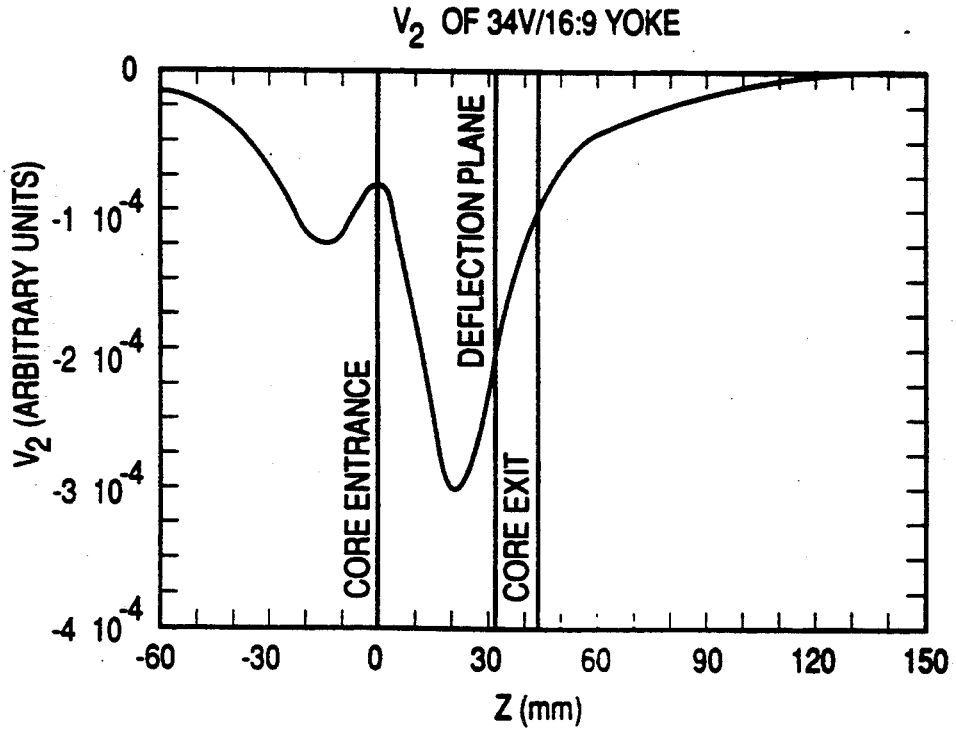
Figure 20:
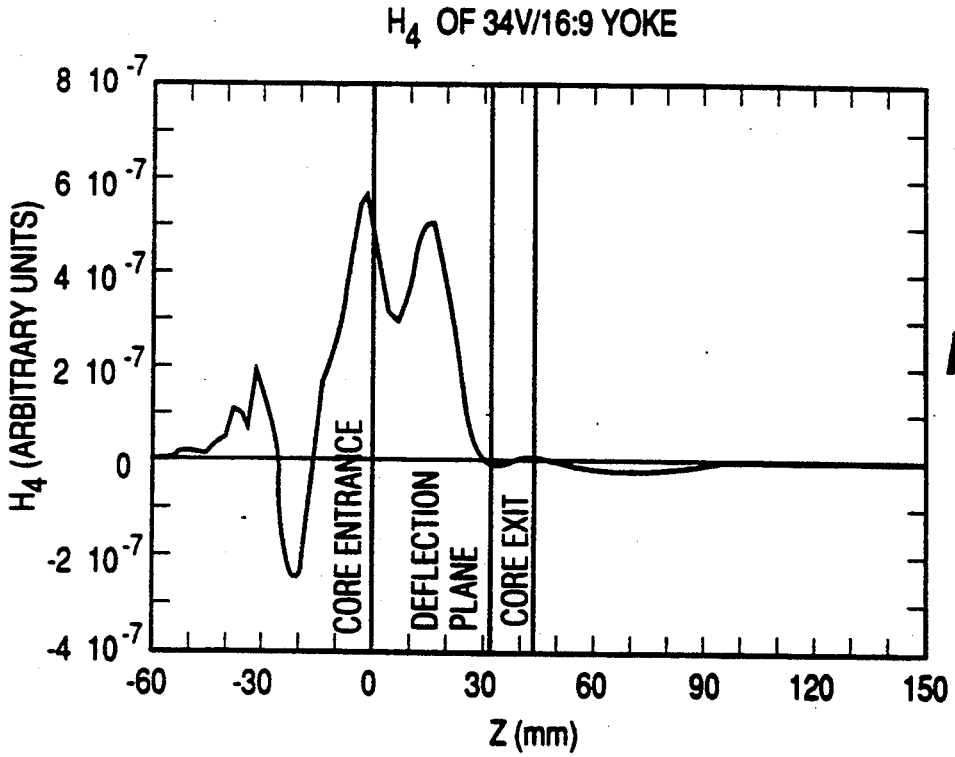
Figure 21:
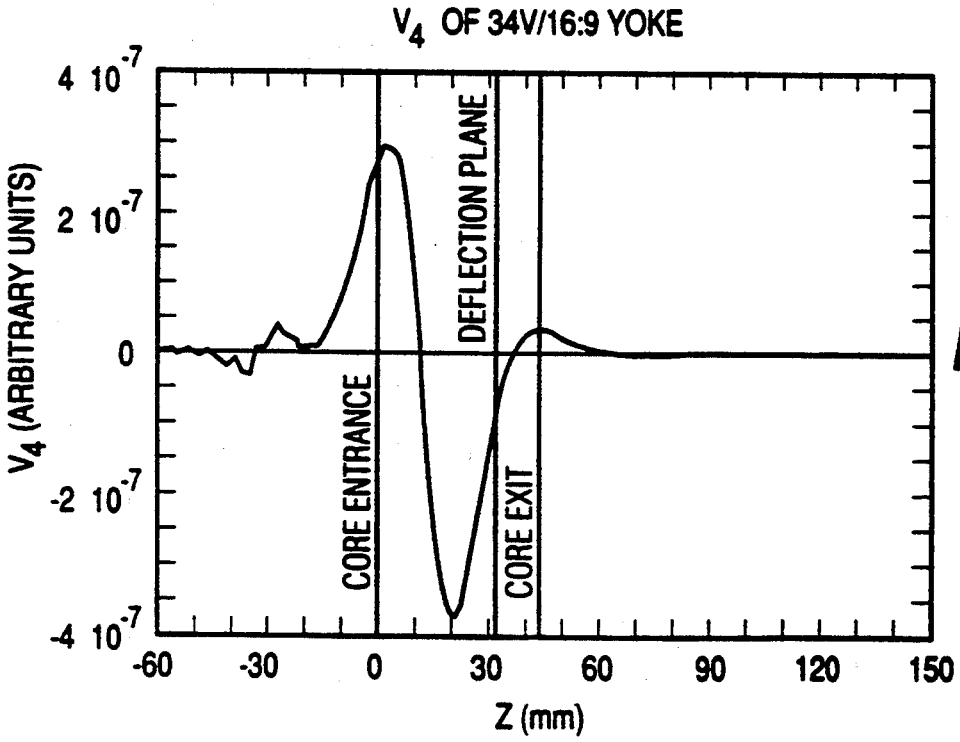
Figure 22A:
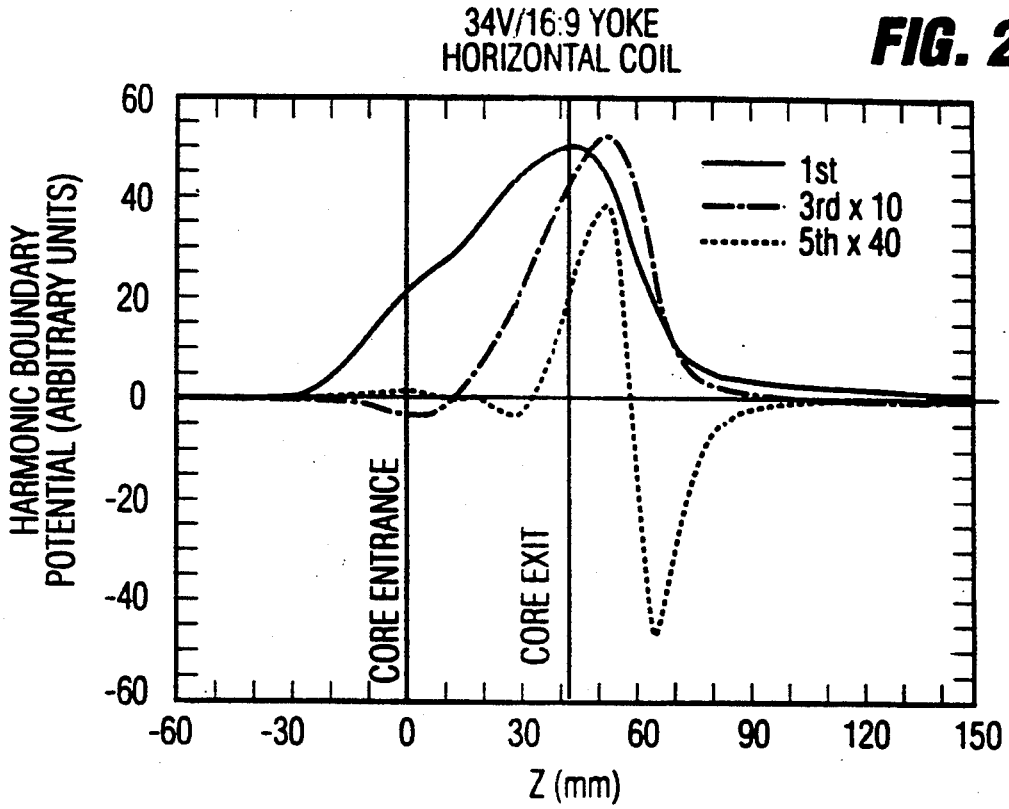
Figure 22B:
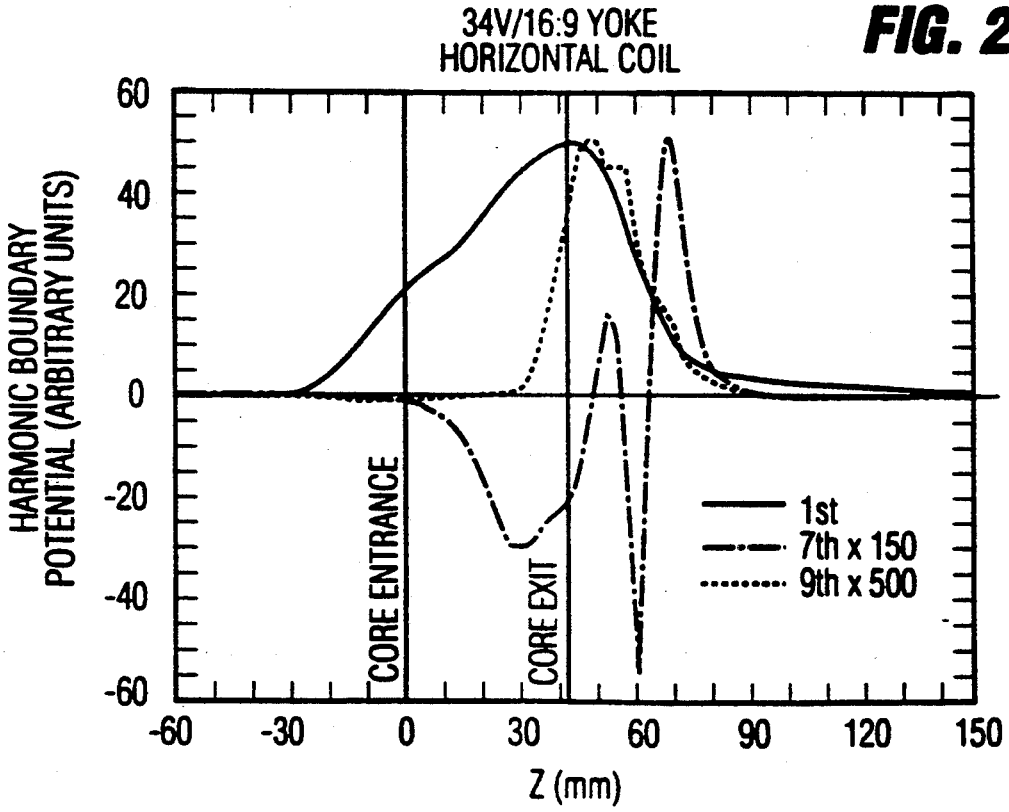
Figure 23A:
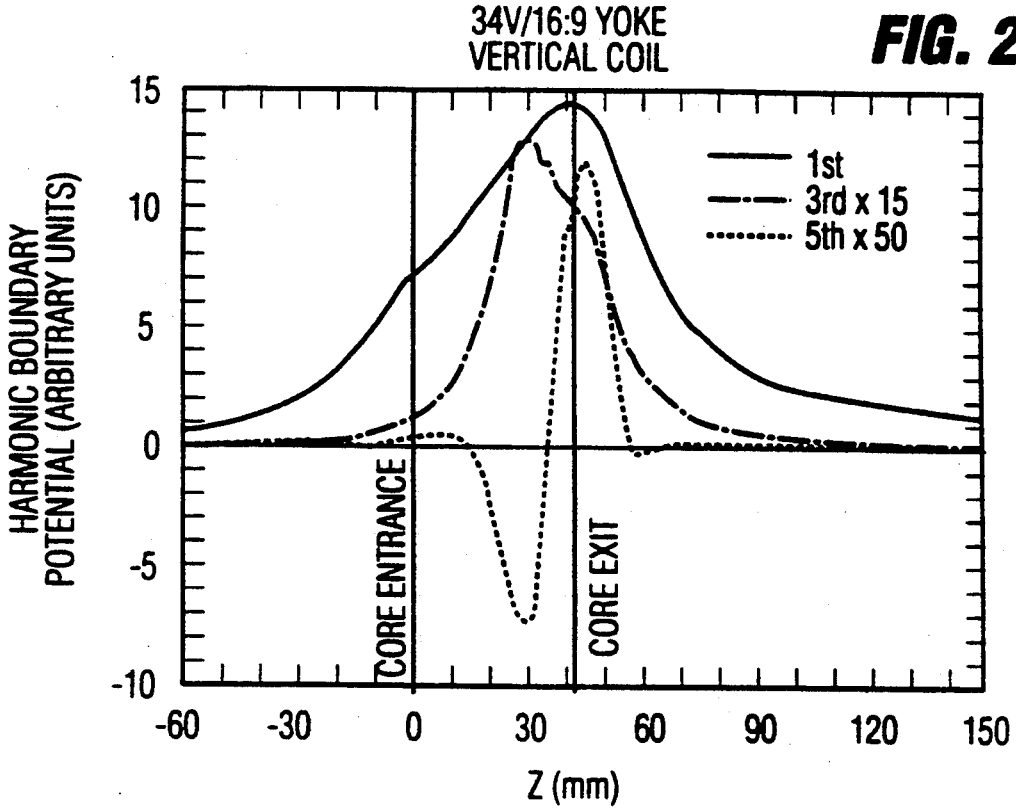
Figure 23B:
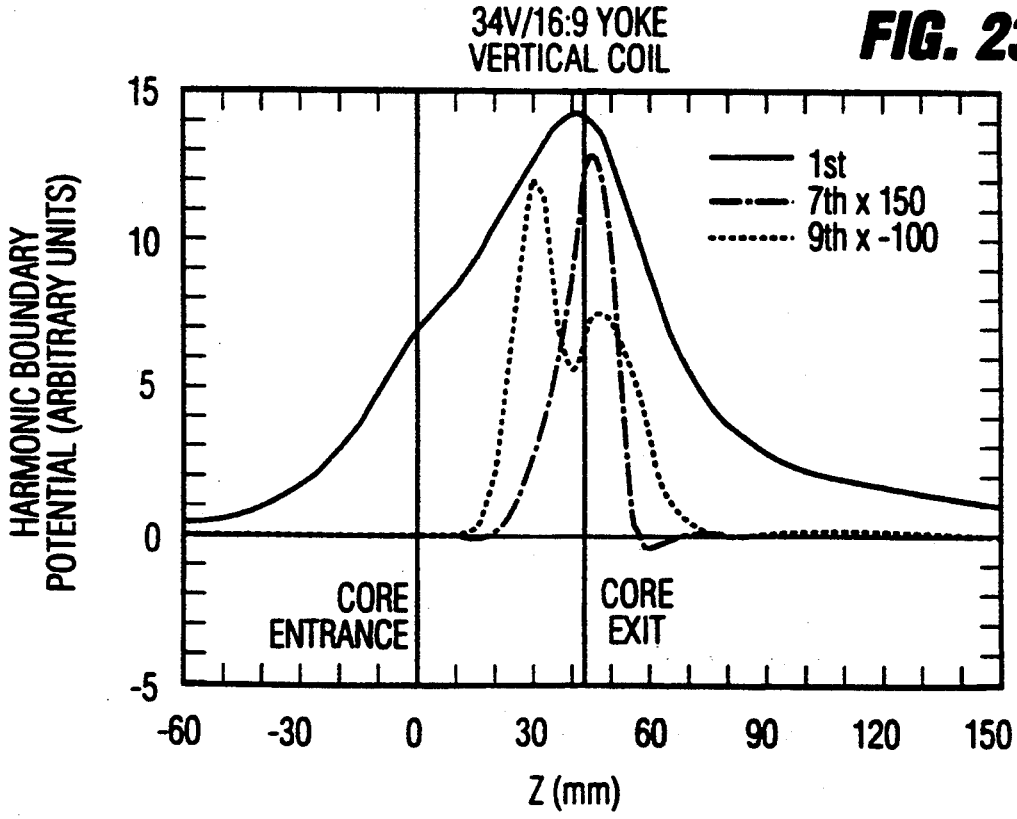
Figure 24:
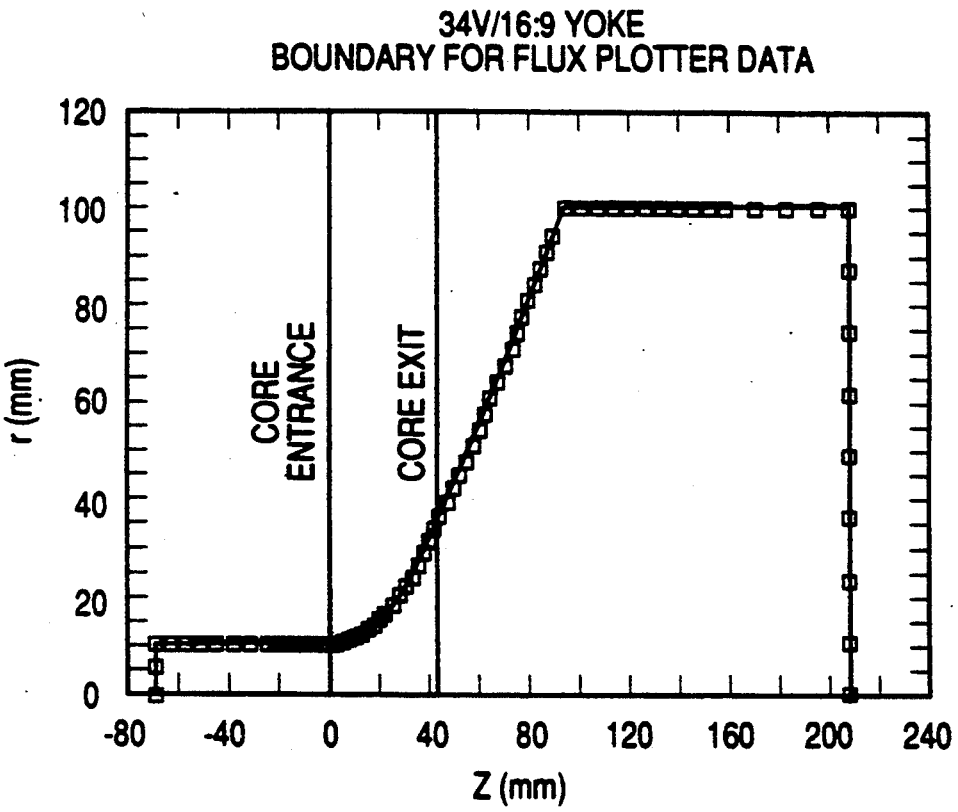

FIGS. 8*a* and 8*b* illustrate in top elevational view two different silicon steel tabs used in the deflection yoke of FIG. 5;

FIG. 8*c* illustrates in isometric view a bar magnet used in the deflection yoke of FIG. 5;

FIG. 9 illustrates in perspective view a horizontal coil used in the deflection yoke of FIG. 5;

FIG. 10 illustrates in front elevation view a vertical coil wound around a magnetic core piece for the deflection yoke of FIG. 5;

FIGS. 11*a*, 11*b* and 11*c* illustrate geometrical relationships between various parameters for a widescreen and comparable narrowscreen picture tube;

FIG. 12 illustrates various electron beam trajectory relationships between self-converging narrowscreen and widescreen deflection systems;

FIG. 13 illustrates curves of outer beam separation versus longitudinal axis location;

FIG. 14 illustrates the H0 and the effective-{H0} field distribution functions associated with the deflection yoke of FIG. 5;

FIG. 15 illustrates curves of various other aberration theory functions associated with the design of the deflection yoke of FIG. 5;

FIGS. 16–24 illustrate curves of various aberration theory functions associated with an exemplary embodiment of a deflection yoke embodying the invention; and FIG. 24 illustrates the surface boundary over which flux plotter data was take for the exemplary embodiment.

Figure 1:
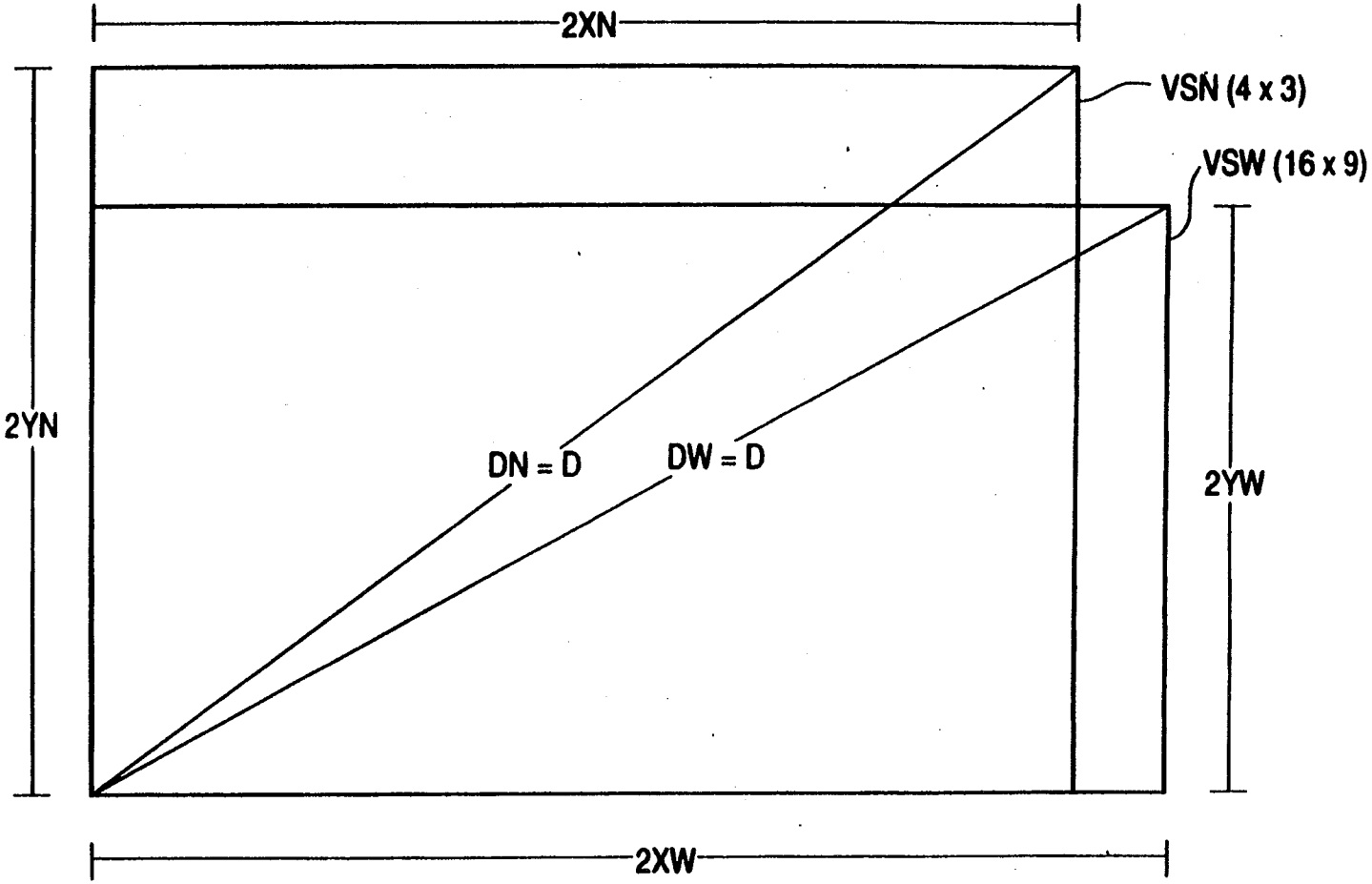
Figure 4:
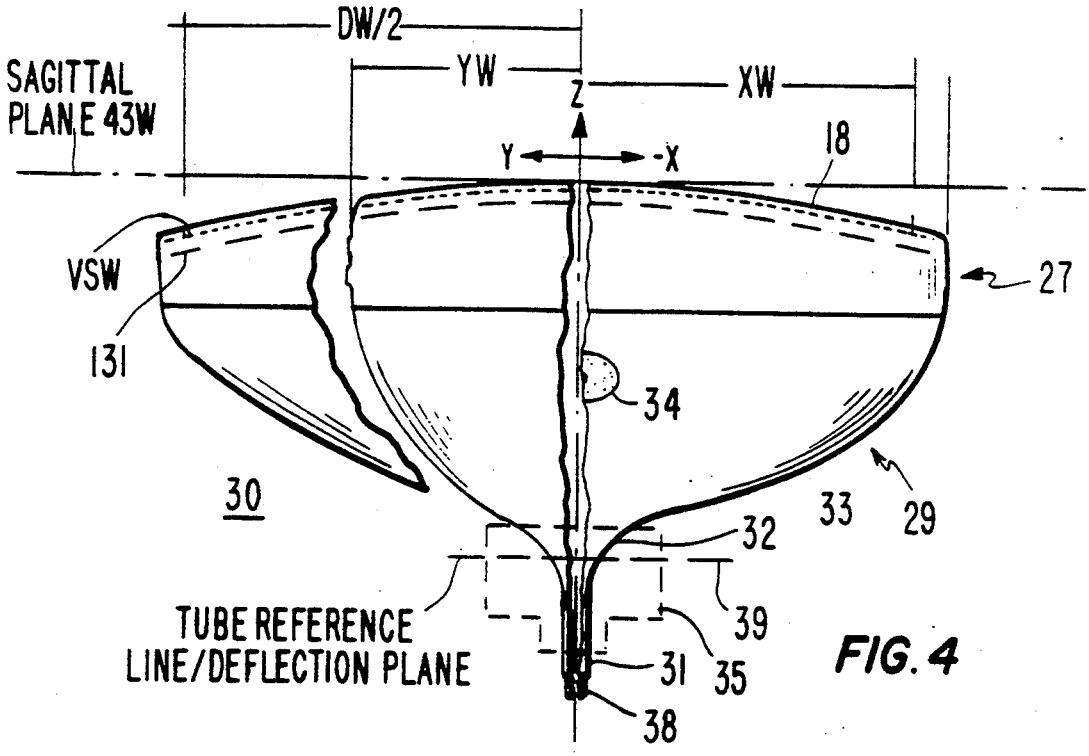
FIG. 4 illustrates various partial, elevational views of an in-line color picture tube of widescreen design having the faceplate of FIG. 2.
Figure 2:
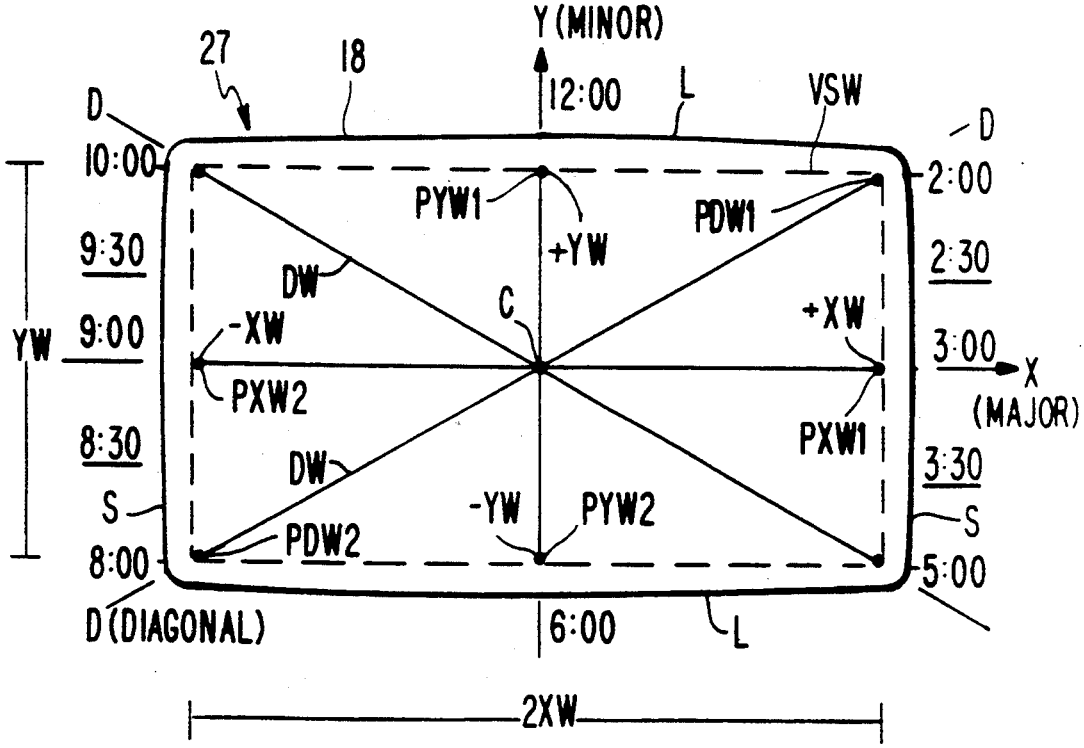
FIG. 2 illustrates in front elevational view the panel faceplate of a 16×9, widescreen picture tube.
Figure 3:
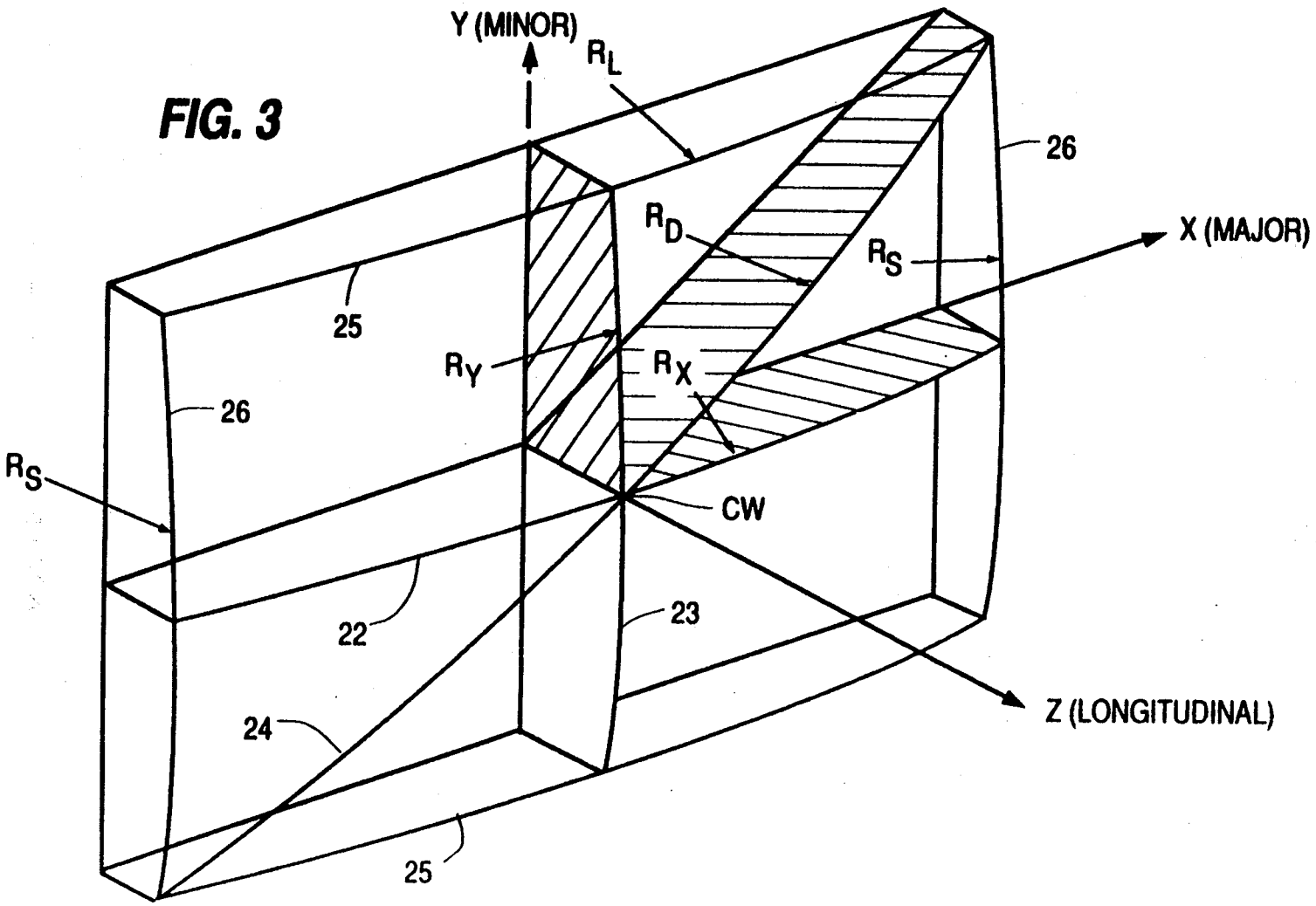
FIG. 3 illustrates the inside surface contour of the faceplate of FIG. 2.

FIG. 4 illustrates a widescreen picture tube 30 that includes the widescreen faceplate of FIG. 2. In FIG. 4, three partial views are shown. A first partial view to the right side of the longitudinal Z axis of picture tube 30 is a top elevational view, as indicated by the orientation of the ZX axes. A second partial view, to the left side of the Z axis, and closest to it, is a side elevational view, as indicated by the orientation of the YZ axes. The third partial view to the left side of the Z axis, and the most remote therefrom, is an elevation view that is normal to diagonal DW of faceplate 18.

In FIG. 4, a panel 27 includes a stripe color phosphor viewing screen VSW deposited on the inner surface of faceplate 18 and a shadow mask 131 secured to panel 27 at a predetermined distance from screen VSW.

Picture tube 30 incorporates a funnel 29 that includes a neck 31 and a bell-shaped flare 33. An anode connection 34 is provided at the top of picture tube 30. An in-line electron gun assembly, not shown in FIG. 4, is located inside neck 31 with rearwardly exiting electrical connector pins inserted into a socket base 38. A deflection assembly 35 is located on picture tube 30 around the forward portion of neck 31 and around the initial flare section 32 of bell-shaped flare 33. Deflection assembly 35 is shown schematically in FIG. 4 by the dashed line box outline.

FIG. 5 illustrates a portion of picture tube 30 of FIG. 4 that includes deflection assembly 35 and the rear section of the picture tube. As illustrated in FIG. 5, deflection assembly 35 includes a plastic housing 36 for mounting a deflection yoke 40 on the picture tube. A sheath beam bender 37 is located to the rear of housing 36 for providing static convergence and purity adjustment. The beam bender is located over a part of an in-line electron gun assembly 28, shown schematically by the dotted line box outline.

In FIG. 4, a tube reference line location 39 may be identified along the longitudinal Z axis. To avoid color purity errors, the in-line electron beams generated by electron gun assembly 28 must be deflected by deflection assembly 35 toward the phosphor viewing screen VSW so as to appear to have been deflected from deflection centers located on the tube reference line. To achieve this result, the longitudinal position of deflection yoke 40 is adjusted to locate tube reference line 39 in the deflection plane of deflection yoke 40.

FIGS. 6–10 illustrate various views of deflection yoke 40 of FIG. 5 or components thereof. Deflection yoke 40 includes a horizontal deflection winding 41 comprising upper and lower saddle-shaped coils 41*a* and 41*b*, and includes a vertical deflection winding 42, comprising two vertical coils 42*a* and 42*b* toroidally wound around respective upper and lower pieces of a magnetic core 50. The saddle-shaped horizontal coils 41*a, b* are located against the inner surface of the plastic separator of housing 36, and magnetic core 50 with the toroidally wound vertical coils 42*a,b* is located around the outside of the plastic separator.

Figure 6:
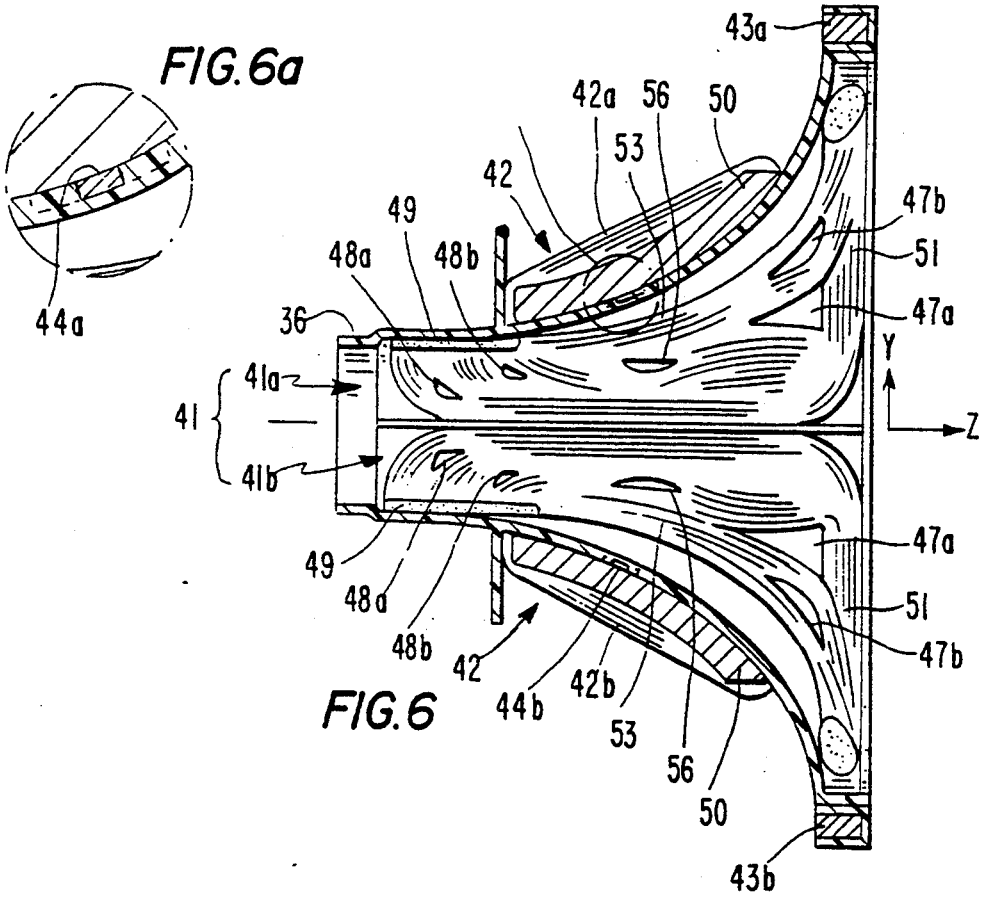
FIG. 6 illustrates a cross-sectional side elevation view of the deflection yoke of FIG. 5.

As illustrated in FIGS. 6, 7 and 9, each of horizontal saddle coils 41*a* and 41*b* has conductor wires wound to produce side members 53, a front end of turn section 51, and a rear end turn section 49, thereby defining a window 46. The conductor wires of side members 53 are directed generally along the longitudinal Z axis of picture tube 30 of FIG. 4, but are shaped to follow the contour of the initial flare section 32 of the picture tube. Front end turn section 51 is bent outwardly, away from the Z axis in a direction generally transverse thereto. Rear end turn section 49 is a straight section that extends generally parallel to the Z axis, with its contour curved in the X and Y directions to follow the shape of neck 31. Spaces or gaps are formed at various points in the conductor wire placement of horizontal coils 41*a* and 41*b* to modify the magnetic field distribution to correct convergence errors and raster distortions as will be described below.

Various views of toroidally wound vertical deflection coils 42*a* and 42*b* are illustrated in FIGS. 5, 6 and 10. The conductor wires of vertical coils 42*a,b* are wound with a wire distribution that produces the desired magnetic field harmonic distribution needed for self convergence in an in-line color picture tube. The inside portions of the wire turns for vertical deflection coils 42*a* and 42*b* are placed tight against the inside of core 50 and closely follow its contour.

Magnetically permeable tabs are affixed to the outside of the plastic separator which separates the vertical and horizontal deflection windings, as illustrated in FIGS. 6 and 7, with a representative tab being shown in perspective view in FIGS. 8*a* and 8*b*. The tabs are angularly and longitudinally located to modify the vertical magnetic field produced by vertical deflection Winding 41 to correct for residual convergence errors and raster distortions, as will also be described below.

To provide good deflection sensitivity, the shape of the inside surface of core 50 and the shape of the horizontal saddle coils 41*a* and 41*b* closely follow the contour of the initial flare section 32 of picture tube 30.

The contour of the initial flare section exhibits a circular cross-section with respect to the longitudinal axis of the picture tube. The radius r of a given cross-section increases with increasing longitudinal axis position z toward the picture tube screen in accordance with the following polynominal equation for the inside glass surface contour:

$$r=a0=a1z+a2z^2+a3z^3+a4z^4$$

where $a0=+10.8948$
$a1=+6.46181\times10^{-2}$
$a2=+1.09119\times10^{-2}$
$a3=+5.70691\times10^{-6}$
$a4=-2.28845\times10^{-7}$ r and z being measured in millimeters. The point z=0 on the longitudinal axis is located at a point that is gun-side and very close to the funnel-neck splice point. The outside glass surface contour is similar to the inside glass surface contour, but offset by the thickness of the glass, which, to provide added strength, becomes thicker with increasing z-distance.

To provide the self converging capability for deflection yoke 40, the magnetic field intensity produced by horizontal deflection winding 41 is made generally pincushion-shaped in the main deflection region, i.e. the region intermediate the entrance region of the deflection field, near the gun-side, rear end turn section, and the exit region, near the screen-side, front end turn section. A pincushion field is a nonuniform field that increases in strength in the direction of deflection. Such a field nonuniformity, when designed into the horizontal deflection field, differentially acts in a divergent manner on the outer blue and red electron beams to produce convergence forces that correct for misconvergence along the major axis of viewing screen VSW of FIGS. 2 and 4, including at the extreme right and left edges of the screen at the 3 o'clock and 9 o'clock positions, ±XW, respectively.

To provide convergence of the outer electron beams along the minor axis, the magnetic field intensity produced by vertical deflection winding 42 is made generally barrel-shaped in the main deflection region of deflection unit 40. A barrel-shaped magnetic field is a nonuniform field which decreases in strength in the direction of deflection. The curvature of the barrel-shaped vertical deflection field generates forces on the outer electron beams to correct for misconvergence along the minor axis, including misconvergence at the extreme top and bottom edges, at the 6 o'clock and 12 o'clock positions, ±YW, respectively.

As a consequence of the effects produced by the pincushion-shaped horizontal and barrel-shaped vertical deflection fields, substantial convergence is achieved at all points on the viewing screen, including along diagonal D and at the corner positions, at the 2, 5, 8 and 10 o'clock positions.

By proper design of the horizontal and vertical magnetic field harmonic distribution, deflection yoke 40 may also provide correction for other convergence errors and for various types of raster distortions. For example, by providing a generally pincushion horizontal deflection field in the exit region, north-south pincushion distortion correction forces are generated. To further enhance the N-S correcting pincushion field at the exit region of the deflection field magnets 43*a* and 43*b* are angularly located along the minor axis just above the front end turns 51. An isometric view of a magnet used for each of the two magnets 43*a,b* is shown in FIG. 8*c*.

Four tabs 45*a*–45*d* made of silicon steel are located at the front of core 50 near the exit region of the vertical magnetic deflection field, with the angular positioning shown in FIG. 7 (oriented approximately 40° from the major axis). The tabs act mainly as vertical field shunts to modify the harmonic field distribution to correct corner trap convergence errors and A-zone trap convergence errors. This correction is achieved, in part, by modifying the seventh harmonic of the vertical field distribution.

A pair of silicon steel tabs 44*a* and 44*b*, angularly located along the minor axis in the main deflection region inside windows 46, act as vertical field shunts to modify the vertical deflection harmonic field distribution. The tabs enhance the overall barrel shape of the vertical deflection field for improving convergence and for providing trilemma correction.

Residual north-south pincushion distortion of a second harmonic nature, known as gullwing distortion, is corrected by modifying the horizontal deflection harmonic field distribution near the exit region of the deflection field by straightening the curvature of the horizontal portions 51*a* of front end turns 51.

A further technique may be used to provide additional convergence and raster distortion correction. This technique involves introducing localized spaces, or gaps, in the winding distribution for the horizontal deflection winding 41. For example, spaces 47*a* and 47*b* are positioned in the front end turn region in a manner that enhances the pincushion shape of the horizontal deflection field in the exit region of the deflection field. This provides additional north-south pincushion correction. Spaces 48*a* and 48*b* are positioned in the rear end turn region and-make the horizontal deflection field in the entrance region less barrel-shaped to provide for a measure of horizontal coma error correction. Spaces 56 are introduced into side members 53, and are located in the main deflection region with the angular positioning shown in FIG. 7 (oriented approximately 25° with the major axis). These spaces correct for convergence errors at the half-hour points of the viewing screen, i.e. at the 2:30, 3:30, 8:30 and 9:30 half-hour screen points.

Deflection yoke 40 need not correct for all types of convergence errors and raster distortions. For example, vertical deflection coils 42*a* and 42*b* may be radially wound and thus provide no significant east-west pincushion distortion correction such as would have been provided by bias wound vertical deflection coils. Vertical coma correction may be provided by field shunts designed into the structure of electron gun assembly 28 of picture tube 30.

Widescreen picture tube 30 is designed to have a relatively wide deflection angle. This point is illustrated in FIG. 11*a* by the schematically drawn perspective view of viewing screen VSW, which screen is deposited on the inner surface of faceplate 18 of FIGS. 2 and 4. As illustrated, widescreen picture tube 30 has a deflection angle of $2\theta DW$, with $2\theta DW$ being defined as the angle between extreme points (PDW1, PDW2) on the diagonal D of viewing screen VSW, where the vertex of angle $2\theta DW$ is the intersection point Z0 of the longitudinal Z axis with tube reference line/deflection plane 39.

For the 16×9 widescreen picture tube 30, deflection angle $2\theta DW=106°$. The deflection angle of 106° is close to the large deflection angle of 110° that is common for a narrowscreen 4×3 aspect ratio picture tube. This keeps the overall length of picture tube 30 relatively short.

Furthermore, when the diagonals of the viewing screens for both the 106° and 110° picture tubes are the same length, then the maximum horizontal deflection angle $2\theta H$ for both tubes has the same value, $2\theta H=96°$, as illustrated in FIG. 11*b* by the schematically represented top elevation view.

This feature has a special advantage in deflection yoke design. When deflected to the extremes of the major axis over a horizontal deflection angle $2\theta H=96°$, the electron beams land at the extremes (PXW1,PXW2) of wide viewing screen VSW, between the major axis screen points ±XW. In contrast, when deflected over the same horizontal deflection angle $2\theta H$, the electron beams of a 110°, 4×3 aspect ratio picture tube land at the extremes (PXN1, PXN2) of 4×3 viewing screen VSN, at the major axis screen points ±XN.

As a result of maintaining the same horizontal deflection angle $2\theta H$, the centerscreen throw distance TW for the wide aspect ratio picture tube is greater than the centerscreen throw distance TN for the narrow aspect ratio picture tube, when the diagonals of the two picture tube are of equal length. Centerscreen throw distance is defined as the separation along the longitudinal Z axis of the deflection plane and a sagittal plane tangent to the center point of the picture tube viewing screen. In FIG. 11*b*, the throw distance TW is the length of line segment (Z0,CW), and the throw distance TN is the length of line segment (Z0,CN). Thus, the 4×3 viewing screen VSN is located closer to the deflection plane than is the 16×9 viewing screen VSW, assuming a commonly located deflection plane for both tubes.

The stored energy in a horizontal deflection winding depends upon the maximum horizontal deflection angle. By keeping this horizontal deflection angle the same for the 110°, 4×3 aspect ratio picture tube and the 106°, 16×9 aspect ratio picture tube, the stored energy requirements of a deflection yoke for the wide aspect ratio picture tube may be kept reasonably close to the stored energy requirements of a deflection yoke for the 4×3 aspect ratio picture tube.

A further advantage that a widescreen picture tube has over a comparable narrowscreen picture tube is that the maximum vertical deflection current required by a widescreen deflection winding is substantially less than that required by a narrowscreen vertical deflection winding, assuming both windings are designed to have about the same deflection sensitivity. This advantage comes about because of the narrower maximum vertical deflection angle $2\theta YW=60°$ for the 106°, 16×9 aspect ratio picture tube 30, as compared to the substantially larger maximum vertical deflection angle $2\theta YN=80°$ for the corresponding 110°, 4×3 aspect ratio picture tube.

As illustrated in FIG. 11*c*, a smaller vertical deflection angle $2\theta YW$ is needed to provide deflection to the extremes (PYW1, PYW2) of viewing screen VSW, between the minor axis screen points ±YW. In contrast, to deflect to the substantially greater extremes (PYN1, PYN2) of narrow aspect ratio viewing screen VSN, between the minor axis screen points ±YN, a substantially greater maximum vertical deflection angle $2\theta YN=80°$ is required.

In accordance with an inventive aspect, widescreen picture tube 30 is provided with a deflection yoke 40 that is self converged. The design of the deflection yoke takes advantage of the fact that the maximum horizontal deflection angle, $2\theta H$, is the same as that of a 110°, 4×3 aspect ratio picture tube.

FIG. 12 illustrates, schematically, the deflection of the three in-line electron beams R,G,B along the major axis of screen VSW of widescreen picture tube 30, and also along the major axis of a conventional 4×3 narrow aspect ratio viewing screen VSN of a conventional 110° picture tube having the same screen contour and screen diagonal as that of widescreen VSW.

As mentioned previously, the center throw distance TW for the widescreen picture tube is greater than the center throw distance TN for the narrowscreen picture tube. This permits the two picture tubes to have the same maximum horizontal deflection angle $2\theta H$.

For simplifying purposes, the two viewing screens VSW and VSN are shown in FIG. 12 by their common, relatively large equivalent radius RX. For deflection winding design analysis, it shall be assumed that the tube reference line/deflection plane 39 for both the conventional and widescreen picture tubes coincide at the point Z) on the longitudinal axis, and that both picture tubes have electron gun assemblies with coincident gun exit planes 56 for the R,G,B electron beams. The separation of the gun exit plane from the deflection plane along the longitudinal axis equals the distance EL.

Consider the outer B and R electron beam convergence situation for convergence along the major axis of the narrow aspect ratio viewing screen VSN. For beam landing at the screen center CN, the electron beams remain undeflected at the deflection plane. Convergence structure in the electron gun assembly provides static convergence of the B and R electron beams at center CN. To achieve this result, each of the outer electron beams emerges from the gun exit plane at an angle to the longitudinal axis of θCN.

In a Gaussian horizontal deflection field, i.e a uniform field, convergence will be maintained at all points on a Gaussian surface, i.e. a spherical surface, that is tangent to the center of the screen and that has a radius of curvature equal to the centerscreen throw distance of the picture tube. Once center convergence has been achieved at point CN, convergence will be maintained at all points on circular arc GSN, when horizontally deflecting in the ZX plane. Thus, at one extreme of horizontal deflection, at a deflection angle θH, a uniform deflection field should produce convergence of the outer electron beams at point PGN.

Because viewing screen VSN is of much flatter curvature, the outer electron beams will cross over before reaching screen point PXN, the 3 o'clock screen point at maximum horizontal deflection along the major axis of the screen. The crossover of the outer electron beams in front of screen VSN produces overconvergence or positive convergence error along the major axis, i.e. the blue beam landing position on screen VSN being to the right of the red beam landing position.

To achieve convergence along the major axis of viewing screen VSN, a self converging deflection system generates a nonuniform, horizontal deflection field of a generally pincushion nature. A pincushion horizontal deflection field corresponds to a deflection field with a positive third harmonic component. The positive third harmonic produces differential horizontal motion of the outer B and R electron beams that is of a divergent nature. By correctly choosing the amplitude of the third harmonic component relative to the fundamental component of the horizontal deflection field, divergent forces produced on the outer electron beams by the third harmonic will move the crossover point of the electron beams to a point located on viewing screen VSN, thereby producing convergence of the outer electron beams.

As illustrated in FIG. 12, when the green electron beam is deflected to the maximum horizontal deflection angle θH, its trajectory is the longitudinal, straight line segment G0, from the electron gun exit plane to the point O in the deflection plane. At the deflection plane, the trajectory shifts to the trajectory GX, until the beam landing point PXN is reached.

The outer B and R electron beams have initial, sloped trajectories BN0 and RN0, respectively, from the gun exit plane to the deflection plane. At the deflection plane, the outer electron beams are deflected by the pincushion-shaped horizontal deflection field into trajectories BNX and RNX which intersect on viewing screen VSN at point PXN. The divergent action produced by the pincushion field is revealed in FIG. 12 by the underconvergence of the outer electron beam at the intersection of their respective trajectories with the Gaussian surface GSN.

The influence of a self converging horizontal deflection field on the separation of the outer electron beams is further illustrated by the curves shown in FIG. 13. The axis of abscissa defines distance along the picture tube longitudinal axis, and the axis of ordinate defines horizontal separation of the outer beams, ΔXBR, in a ZX plane normal to the longitudinal axis at a given point Z along the longitudinal axis. A negative value for ΔXBR represents a blue electron beam position that is to the right of the red electron beam position.

In FIG. 13, solid line curve 54 illustrates outer beam separation for a conventional 110° deflection, 4×3 aspect ratio picture tube having a self-converging deflection yoke. At the electron gun exit plane, at longitudinal location ZE, the outer beam separation is $-\Delta XBRE = -2sE$, where sE is the S-spacing between the green center electron beam and either of the red and blue outer electron beams, as referenced beam-center to beam-center. Illustrative of a typical gun S-spacing magnitude is the S-spacing for a COTY-M electron gun, scaled for use in a 34 V 110°, 4×3 aspect ratio picture tube. For this gun, the S-spacing is sE=6.5 millimeter, resulting in an outer beam separation of $-\Delta XBRE = -13$ millimeter.

Due to the initial slope angle 2θCN between the trajectories of the outer electron beams required for centerscreen convergence, the separation of the outer electron beams decreases as the electron beams travel toward the screen, away from the electron gun exit plane. As illustrated by curve segment 54*a* of FIG. 13, the outer beam separation ΔXBR linearly decreases in magnitude in the predeflection region, from longitudinal axis point ZE to longitudinal axis point ZD1. Near longitudinal axis point ZD1, the electron beams enter into the entrance region of the horizontal deflection field which begins deflecting the electron beams toward the 3 o'clock position on the major axis of the picture tube viewing screen.

Segment 54*b* of curve 54 illustrates the outer beam separation as the electron beams interact with the horizontal deflection field—a field which has an entrance region near longitudinal axis point ZD1 and an exit region near longitudinal axis point ZD2. The deflection plane of the self-converging deflection unit is located at a point intermediate the entrance and exit regions of the horizontal deflection field, at a longitudinal axis point Z0, typically positioned within the main deflection region.

Due to the pincushion nature of the horizontal deflection field, a differential horizontal force of a diverging nature is impressed upon the outer electron beams. This results in the outer beam separation ΔXBR changing less rapidly within the deflection region (ZD1,ZD2), when compared to the change in outer beam separation for a uniform deflection field. Thus, in FIG. 13, the slope of curve segment 54*b* in the deflection field is shallower than the slope of curve segment 54*a*.

After exiting the horizontal deflection region near longitudinal axis point ZD2, the underconverged condition of the outer electron beams has been reduced to the point where the electron beam crossover, i.e. the point where ΔXBR=0, has been moved away from the Gaussian surface to the viewing screen longitudinal axis location ZNX. This is illustrated in FIG. 13 by linear curve segment 54*c*, in the post-deflection region, decreasing in magnitude from a magnitude ΔXBR2 at location ZD2 to 0 at viewing screen location ZNX.

A problem arises should one attempt to adapt the design of a self converging deflection yoke of a 4×3 aspect ratio picture tube for use in a comparable wide-screen picture tube having the same horizontal deflection angle. To maintain the same horizontal deflection angle θH as measured from the longitudinal axis, the center throw distance TW in FIG. 12 must be made greater than the center throw distance TN for the 4×3 aspect ratio picture tube, given that both tubes have the same diagonal length. Viewing screen VSW for the widescreen picture tube is therefore longitudinally located at a point farther away from the deflection plane.

To achieve convergence at the center CW of wide viewing screen VSW, the center convergence angle imparted onto each of the outer electron beams at the gun exit plane of FIG. 12 is an angle θCW. Because of the longer throw distance TW, this angle is smaller than the center convergence angle θCN for the comparable narrowscreen picture tube. For a uniform horizontal deflection field, convergence of the outer electron beams in the widescreen picture tube will be maintained at points on the Gaussian surface GSW of FIG. 12.

Ordinarily, one would expect that the positive horizontal third harmonic content of a yoke designed for a 4×3 aspect ratio picture tube would provide sufficient divergent forces on the outer beams to provide a crossover point reasonably close to point PXW on viewing screen VSW, provided the yoke were used on a comparable widescreen picture tube, i.e. a picture tube having the same horizontal deflection angle, diagonal length and screen contour.

What actually happens, however, when such a deflection yoke is used on a widescreen picture tube is that a substantial underconvergence condition is created moving the outer beam crossover point to point PU, well-behind screen VSW.

This relatively large underconvergence is due to the fact that the strength of the positive horizontal third harmonic of a deflection yoke designed for a 4×3 aspect ratio picture tube is greater than required for use in a comparable 16×9 aspect ratio picture tube. The result is an excessive divergent force on the outer electron beams, producing an underconvergence condition at the 3 o'clock position XW on the major axis of viewing screen VSW.

As illustrated in FIG. 12, the initial trajectories RW0 and BW0 of the outer electron beams for the widescreen picture tube become the trajectories RNX and BNX when the electron beams are deflected in the deflection plane toward the 3 o'clock point XW. Because of the excessive differential, divergent force introduced by the nonuniform horizontal deflection field, the crossover point for the outer electron beams is substantially behind screen VSW at point PU. This results in an underconvergence condition at point PXW, the beam landing point for the trajectory GX of the center green beam. The amount of underconvergence −ΔXBRW can be substantial for large screen, wide aspect ratio picture tubes, up to 2 millimeters or more of underconvergence.

From the above discussion, one notes that a self-converged deflection yoke designed for a 4×3 aspect ratio picture tube, when used in a comparable 16×9 wide aspect ratio picture tube, produces an underconvergence condition on the wide viewing screen rather than an anticipated nearly converged condition.

A major contributor to the underconvergence of the electron beams at viewing screen VSW of FIG. 12 is the greater S-spacing sW of the electron beams in the deflection plane. The greater S-spacing is a result of the shallower initial slope or smaller centerscreen convergence angle of the outer beam trajectories BW0 and RW0 for the widescreen picture tube.

Because the S-spacing in the deflection plane is greater, the outer electron beams enter the horizontal deflection field at points farther away from the longitudinal axis. For a given pincushion horizontal field, this results in a substantially greater differential between the strength of the horizontal field encountered by one outer beam and the strength encountered by the other outer beam. Thus, in FIG. 12, when the outer electron beams are deflected by an angle θH to the point PXW, the red beam R interacts with a significantly stronger horizontal deflection field than the blue beam B, as they travel through the horizontal deflection field. The resultant increase in the divergent forces on the outer electron beams establishes a crossover point PU that is behind, rather than in front, of viewing screen VSW.

Curve 55 of FIG. 13 illustrates why the smaller centerscreen convergence angle θCW in a widescreen picture tube contributes to the underconvergence condition on viewing screen VSW. At the electron gun exit plane, at longitudinal location ZE, the separation of the outer beams is the same value, −ΔXBRE, as that for the comparable narrowscreen picture tube. This separation is equal to twice the S-spacing, or −2sE.

Because of the shallower initial slope of the electron beam trajectories in the widescreen picture tube, the outer beam separation decreases in magnitude at a lesser rate, producing curve segment 55*a* of FIG. 13. As the electron beams travel from the gun exit plane to the entrance region of the horizontal deflection field near longitudinal location ZD1, the outer beam separation at the entrance region, −ΔXBR3, is greater in magnitude than the outer beam separation, −ΔXBR1, for the narrowscreen picture tube. As a result, a stronger divergent force acts on the outer electron beams, causing the outer beam separation to decrease more slowly as the electron beams travel through the deflection region from the entrance region point ZD1 to the exit region point ZD2. This is indicated by the more shallow curve segment 55*b*. Near the exit region of the deflection field, at point ZD2, the outer beam separation, −ΔXBR4, is substantially greater in magnitude than the outer beam separation, −ΔXBR2, for the narrowscreen picture tube.

As a result, after exiting the deflection yoke region, the outer electron beams have not been differentially deflected sufficiently to converge the beams on screen VSW. As shown in FIG. 13, the outer beam separation after the electron beams emerge from the exit region of the deflection field, as represented by curve segment 55*c*, results in an underconvergence of −ΔXBRW when the electron beams have reached viewing screen VSW at longitudinal location ZWX.

In accordance with an inventive arrangement, deflection yoke 40 of FIG. 5 is designed to provide self convergence of the electron beams in conjunction with their deflection in widescreen picture tube 30 of FIG. 4. The design takes into account differences in S-spacing at the tube reference line/deflection plane and differences in centerscreen convergence angle between the 16×9, wide aspect ratio picture tube and a comparable 4×3, narrow aspect ratio picture tube having the same maximum horizontal deflection angle, diagonal length, and screen contour.

Furthermore, in accordance with an aspect of the invention, to eliminate what would otherwise have been a large misconvergence condition at the extremes of the major-axis of the 16×9, wide aspect ratio viewing screen, the harmonic distribution of the horizontal deflection field is modified. The modification is accomplished mainly via changes in the amplitude of the third harmonic relative to the fundamental, based upon the previously mentioned differences in S-spacing at the tube reference line/deflection plane and centerscreen convergence angle.

Although modifications to the higher harmonics may be attempted in order to correct for the above-described misconvergence condition, changes in these higher harmonic components tend to undesirably introduce other types of convergence errors and raster distortions.

The amount of change in the third harmonic needed to eliminate the underconvergence condition may be ascertained by using aberration theory to analyze electron-optical performance of a deflection yoke. The notation used below is an adaptation of the notation used in aberration theory where H0(z) and H2(z) are the field distribution functions representing the Gaussian deflection field and the $x^2$ transverse non-uniformity of the horizontal deflection field, as generated in a power series expansion of the horizontal deflection field. This theory is expounded in such papers as the article by J. Kaashoek, in "Philips Research Reports Supplements", Number 11, 1968, and in such patents as U.S. Pat. No. 4329671, "Alignment-Insensitive Self-Converging In-Line Color Display, by J. Gross and W. H. Barkow, issued May 11, 1982.

As noted previously, self convergence along the major axis of the viewing screen requires a generally pincushion-shaped horizontal deflection field. A pincushion-shaped deflection field is characterized by a positive H2 field distribution function. According to an inventive feature, the third harmonic content of the horizontal deflection field in a widescreen picture tube should be reduced relative to the third harmonic in a comparable narrowscreen picture tube in accordance with the following nonuniformity ratio:

$$H2R = h2_{(TW)} \div h2_{(TN)} = \{H2\}_{(TW)} \div \{H2\}_{(TN)}$$

where h2={H2}÷{H0}, and where TW and TN are defined as the centerscreen throw distances for the widescreen and narrowscreen picture tubes, respectively. {H0} and {H2} are the effective Gaussian and $x^2$-nonuniformity field distribution functions, as will be described below.

From the above equations one notes that h2 is the field distribution function normalized to Gaussian deflection. One also notes that h2, {H0} and {H2} are functions of the throw distance parameters TW and TN.

In aberration theory, the effective field distribution functions {H0} and {H2} are defined in terms of the effective length $l_e$ of the horizontal deflection field. The effective length $l_e$ is defined as the width of a rectangle having the same area as the area underneath the Gaussian field distribution function H0 and a height equal to the maximum value H0(max) of the function H0. The rectangle is centered around point Z0 on the longitudinal axis, where the deflection plane is located.

FIG. 14 shows a curve 57 of H0 as a function of z for an exemplary embodiment of a self converged widescreen deflection yoke 40 of FIG. 5 that provides deflection of the three in-line electron beams in widescreen picture tube 30 of FIG. 4. The axis of ordinate is graduated in arbitrary units and the zero point of the axis of abscissa is referenced to the entrance end of magnetic core 50.

As shown in FIG. 14, curve H0 reaches a maximum value H0(max) in the main deflection region at a Z-axis point ZM, gun-side of the deflection plane. The rectangle 58 is constructed having the same area as that of the H0 curve 57 and having a width equal to the effective length and a height equal to H0(max).

Based upon some simplifying assumptions in aberration theory, the effective Gaussian field distribution function {H0} may be defined as equal to the constant H0(max) over the effective length and equal to zero elsewhere. {H0} may then be used instead of H0 to calculate the Gaussian trajectory beam landing location at the viewing screen after the electron beams have interacted with the horizontal deflection field.

A similar simplifying procedure may be used to derive the effective nonuniformity field distribution function {H2}. {H2} may then be used instead of the actual field distribution function H2 when analyzing the effect of H2 on horizontal astigmatism, i.e. on convergence.

FIG. 15 shows a solid-line curve 59 of H2 as a function of z for the previously discussed widescreen deflection yoke 40. The H2 curve 59 is negative in the entrance region of the deflection field, gun-side of the core entrance point. A negative value indicates a barrel-shaped field, produced in part by the straight rear end turn section of horizontal deflection coils 41*a,b*. The barrel-shaped field provides horizontal coma correction.

The H2 curve is almost entirely positive in the main deflection region, extending to either side of the deflection plane. A positive H2 value indicates a pincushion-shaped deflection field for providing horizontal astigmatism correction.

The H2 curve stays mainly positive after exiting the main deflection region screen-side of the core, thereby providing correction of N-S pincushion distortion.

The effective H2 function, {H2}, equals H2(max) over the effective length $l_e$ of the deflection field, i.e. between points (ZL1, ZL2), and equals zero elsewhere. In FIG. 15, rectangle 60, centered around the deflection plane, is the curve of the function {H2}.

{H2} is used in aberration theory as a simplified substitution for the actual H2 function in various integral equations used in developing general aberration expressions describing the differences Δx and Δy at the viewing screen between the Gaussian beam landing location and the beam landing location computed by third or fifth-order aberration theory.

As an example, for horizontal astigmatism, the S2 integral is a major influence on convergence via the $A_4$ coefficient, where:

$$S2 = 2/X_S^2 \int H2X[z-z_S]^2 d_z$$

where $X_S$ is the x-coordinate of Gaussian deflection point on the viewing screen when the screen is located at z-axis point $z_S$;

where

X is the x-coordinate of the electron beam Gaussian trajectory, the trajectory being a function of z-axis location; and where the $A_4$ coefficient is used in the horizontal astigmatism equation:

$$\Delta x_{B-R} = 2A_4 X_S^2 x_S'$$

where $\Delta x_{B-R}$ is the horizontal separation of the blue and red outer electron beams at the screen x-coordinate $X_S$, where $x_S'$ is the slope of the electron beam trajectory at screen coordinate $X_S$, and where:

$$A_4 = \frac{3}{2T0}[1 - \lambda/6] - S2$$

T0 being the centerscreen throw distance, and where $\lambda = l_e/D$, D being the separation of the deflection and sagittal planes.

From the above equation for the S2 integral one notes that the argument of the S2 integral is the weighted H2 expression $H2X[z-z_s]2$. This argument is shown in FIG. 15 as the dashed line curve 61. Curve 61 is predominantly composed of a large positive lobe 61*a*, peaking near the deflection plane. The S2 integral, being proportional to the area under curve 61, is therefore positive due to the large positive lobe 61*a*.

By proper horizontal deflection winding design, the S2 integral is made positive to a point where the $A_4$ coefficient, as defined above, becomes zero, thereby eliminating horizontal astigmatism, i.e. $\Delta x_{B-R}=0$.

As previously mentioned, the argument of the S2 integral is the weighted H2 expression $H2X[z-z_S]^2$. By using the effective H2 function, {H2}, the S2 integral equation simplifies to:

$$S2=2\{H2\}/X_S^2 \int X(z-z_S)^2 dz.$$

S2 thus becomes proportional to the integral of the Gaussian trajectory weighted by the square of the z-axis distance of the electron beam from the viewing screen, where the integration is performed only over the effective length $l_e$.

When an analysis is made of the self convergence parameters needed for a deflection yoke in a widescreen picture tube, using the effective field distribution functions {H0} and {H2} as part of the analysis, the required nonuniformity ratio H2R, previously defined, becomes:

$$H2R = \frac{[6d - \lambda][10 - 5\lambda + \lambda^2]}{[6 - \lambda][10d^2 - 5d\lambda + \lambda^2]}$$

where $d = TW \div TN$ $\lambda = l_e \div TN$.

From the above equations, one notes that d is the ratio of the widescreen to narrowscreen center throw distances, and λ is the ratio of effective length of the horizontal deflection field to the narrowscreen center throw distance.

A further simplification can be made based upon the fact that the ratio $\lambda = l_e \div TN$ is small compared to the ratio $d = TW \div TN$. The expression for the nonuniformity ratio H2R becomes:

$$H2R = 1/d.$$

A similar analysis may be performed with respect to the requirements of reducing the horizontal third harmonic in a widescreen deflection yoke to make a ratio of S2 integrals such as to compensate for the more severe underconvergence geometry condition existing in a widescreen picture tube due to center screen throw distance differences from a comparable narrowscreen picture tube. An S2 ratio S2R may be defined as:

$$S2R = S2(TW) \div S2(TN)$$

where the S2 integral equations previously provided become parameters of the respective center throw distances TW and TN.

Based upon aberration theory, a widescreen deflection yoke design should satisfy the following S2 ratio equation when modifying the third harmonic content of the widescreen deflection yoke relative to the third harmonic of a comparable narrowscreen deflection yoke design.

$$S2R = \frac{6d - \lambda}{[6 - \lambda]d^2}.$$

When the value of the ratio λ is substantially smaller than the value of the ratio d, the S2 ratio simplifies to $$S2R = 1/d.$$

This is the same requirement as for the simplified H2 ratio, H2R, stated above.

One notes from FIG. 15 that both the S2 curve 61 and the H2 curve 59 show similar positive lobes, 61*a* and 59*a* respectively, over the effective length $l_e$ of the horizontal deflection field. These positive lobes are the main influences on horizontal astigmatism correction. Thus, the identity of the two ratios:

$$S2R = H2R = 1/d$$

can be explained on this basis.

In accordance with an aspect of the invention, the third harmonic content of the horizontal deflection field for a widescreen picture tube should be reduced relative to the third harmonic content in a comparable narrowscreen picture tube by an amount that provides for the nonuniformity ratio or, alternatively the S2 ratio, to be equal to 1/d, the reciprocal of the center throw distance ratio for the two tubes.

Since both the widescreen and narrowscreen picture tubes have the same horizontal deflection angle 2θH and the same diagonal length, then the following geometric relationship exists between center screen throw distances TW and TN and picture tube viewing screen aspect ratios $\alpha_W$ and $\alpha_N$:

$$d = TW \div TN = \sqrt{[1 + \alpha_N^{-2}]/[1 + \alpha_W^{-2}]}$$

where $\alpha_W$ and $\alpha_N$ equal the aspect ratios of the viewing screens for the wide and narrow aspect ratio picture tubes, respectively.

In view of the above relationship between throw distance and aspect ratio, the nonuniformity ratio H2R may be expressed as follows:

$$H2R = 1/d = \sqrt{[1 + \alpha_W^{-2}]/[1 + \alpha_N^{-2}]}$$

As an example, for a narrowscreen aspect ratio of 4×3, $\alpha_N = 1.33$, and for a widescreen aspect ratio of $\alpha_W = 1.78$, the H2 ratio becomes: H2R=0.92.

From the above relationships, one notes that to maintain convergence at the extremes of the major axis of the viewing screen of a wide aspect ratio picture tube, it is advantageous to reduce the third harmonic of the horizontal deflection field in a self converging widescreen deflection yoke design relative to the third harmonic in a comparably designed narrowscreen deflection yoke. The third harmonic is reduced by an amount that enables the nonuniformity ratio H2R, or alternatively the S2 ratio S2R, to be equal to the throw distance ratio for the two picture tubes. In this way, horizontal astigmatism at the extremes of the major axis of the viewing screen may be substantially corrected, e.g., the amount of misconvergence being reduced to approximately 1.5 millimeter or less.

The importance of the above-described relationships increases as the horizontal deflection angle, center-screen throw distance, and diagonal length increase, and as the aspect ratio gets wider; e.g. for diagonal lengths between 66 centimeter (26 V) and 96.5 centimeter (38 V), aspect ratios between 1.67 (5×3) and 2.0 (2×1), and a large horizontal deflection angle near 96°.

The horizontal third harmonic advantageously may be reduced by providing an increased number of conductor wires for each of horizontal coils 41*a* and 41*b* of FIGS. 6, 7 and 9 in side members 53 at angular positions remote from the horizontal axis. Locating wires in these positions narrows window 46 making the horizontal deflection field less pincushion-shaped, thereby reducing the amplitude of the positive third harmonic, and thus reducing the amplitude of the positive H2 field distribution function. To provide self-convergence along the major axis of the 16×9 aspect ratio picture tube, the change in the number of wires and their angular placement are such as to satisfy the condition that the nonuniformity ratio H2R or the S2 ratio S2R equal the reciprocal of the throw distance ratio d.

Although higher harmonics may also be modified to remove the underconvergence condition, such a change could undesirably introduce other errors. For example, the horizontal 5th harmonic can be modified so as to counteract the effects of a too strong positive 3rd harmonic. Undesireably, however, an accompanying result would be to aggrevate N-S gullwing errors and introduce corner convergence errors. Therefore, in accordance with an aspect of the invention, the third harmonic is the principal mechanism, via the H2 or S2 ratio, by which self convergence is reachieved.

TABLE II lists various parameters associated with self-convergence in an exemplary inventive embodiment of a deflection yoke 40 for a widescreen picture tube 30.

TABLE II

| | |
|---|---|
| DW = 86.3 cm | tan(θCN) = 0.0143203<br>tan(θCW) = 0.013391 |
| 2XW = 75.2 cm | |
| 2YW = 42.2 cm | 2sN = 10.102 mm<br>2sW = 10.290 mm<br>2θDW = 106°<br>2θDN = 110° |
| Length of horizontal coil = 82.5 mm | 2θH = 96°<br>2θYW = 60° |
| Length of magnetic core = 43.1 mm | 2θYN = 80° |
| Height from sagittal plane at ± XW = 42 mm | $l_e$ = 69.1 mm |
| Height from sagittal plane at ± XY = 20 mm | $\alpha_W$ = 1.78 |
| Height from sagittal plane at screen corners = 59 mm | $\alpha_N$ = 1.33 |
| TN = 352.7 mm<br>TW = 384.2 mm | z-separation of deflection plane from core enterance = 31.4 mm |
| z-separation of deflection plane from rear of horizontal coil = 54.3 mm | |

The angular distribution of the wires for the vertical deflection coils of the exemplary embodiment, when decomposed harmonically, have the following coefficients, normalized to the fundemental A0:

$$A3/A0=-0.25\ A5/A0=+0.08\ A7/A0=0$$
$$A9/A0=-0.55$$

The horizontal field distribution functions H0,H2,H4 and the vertical field distribution functions V0,V2,V4 for the exemplary embodiment are illustrated in FIGS. 16–21.

An alternative way of describing the magnetic field of the exemplary embodiment is by curves of the harmonics of the scalar potential Ψ of the magnetic field intensity H. The harmonics of the scalar potential are directly related to the harmonics of the magnetic field intensity, and only odd harmonics are generated. FIGS. 22 and 23 illustrate the first five harmonics of the horizontal and vertical scalar potentials. These potentials were computed from flux plotter data measured over a surface of revolution that is defined and encompassed by the inner surface contour of the initial flair section of the widescreen picture tube, but separated therefrom by 2.5 millimeter. The surface of revolution over which the data was taken is shown in FIG. 24.

What is claimed is:

1. A self converging widescreen color picture tube system, characterized by:

a widescreen, in-line color picture tube (30) having a funnel (29), an electron gun assembly (28) for three in-line electron beams located in a neck (51) at one end of said picture tube, and a faceplate (18) with a wide viewing screen (VSW) at the other end, said viewing screen having a wide aspect ratio, against a comparable narrowscreen, in-line color picture tube having a narrow viewing screen with an aspect ratio of approximately 1.33, where the two picture tubes have the same diagonal length, the same screen contour, and the same horizontal deflection angle as measured from their respective tube reference lines between extremes of their respective major axes;

a self converging widescreen deflection yoke (40) including horizontal (41) and vertical (42) deflection windings, said yoke being located by an initial flare section (32) of said funnel and positioned along the longitudinal axis of said widescreen picture tube to make the tube reference line thereof and the yoke deflection plane substantially coincident;

wherein to achieve substantial horizontal astigmatism correction at the extremes of the major axis of said wide viewing screen, said horizontal deflection winding is constructed to have a horizontal deflection field that exhibits a third harmonic component that results in an effective H2 field distribution function for said yoke which satisfies a requirement that a nonuniformity ratio H2R be substantially equal to the reciprocal of the throw distance ratio, the throw distance ratio being defined as d=TW/TN, where TW is the throw distance for said widescreen picture tube, TN is the throw distance for said comparable narrowscreen picture tube, and where the nonuniformity ratio H2R is the ratio of the effective H2 field distribution function of the horizontal deflection field for said widescreen yoke to the effective H2 field distribution function of the horizontal deflection field for a comparable narrowscreen self converging yoke associated with said narrowscreen picture tube.

2. A system according to claim 1 characterized in that said widescreen yoke has a pincushion-shaped horizontal deflection field that is significantly weaker than that of said narrowscreen yoke in accordance with said nonuniformity ratio, to avoid an underconvergence condition from existing at the extremes of the wide viewing screen major axis, that would otherwise have placed the crossover point of the outer electron beams substantially behind said wide viewing screen.

3. A system according to claim 2 characterized in that the S-spacing of the outer electron beams at the deflection plane in said widescreen picture tube is greater then that of said narrowscreen picture tube, thereby subjecting said outer electron beams to greater differential forces of a diverging nature produced by the electron beams passing through the pincushion-shaped horizontal deflection field of the widescreen yoke, as compared to the differential forces produced by the horizontal deflection field of the narrowscreen yoke.

4. A system according to claim 3 characterized in that the centerscreen convergence angle for said widescreen picture tube is smaller than that of said narrowscreen picture tube, thereby subjecting said outer electron beams to greater differential forces of a diverging nature produced by the electron beams passing through the pincushion-shaped horizontal deflection field of the widescreen yoke, as compared to the differential forces produced by the horizontal deflection field of the narrowscreen yoke.

5. A system according to claim 1 characterized in that said wide viewing screen has a large diagonal length between 66 centimeter and 96.5 centimeter.

6. A system according to claim 1 characterized in that said wide aspect ratio is substantantially between the range of 1.67 and 2.0.

7. A system according to claim 1 characterized in that said wide aspect ratio is about 1.78, and where said horizontal defection angle is about 96°, resulting thereby in a widescreen tube deflection angle of about 106°, as measured from the tube reference line between extremes of the viewing screen diagonal.

8. A system according to claim 7 characterized in that said wide viewing screen has a large diagonal length substantially between 66 centimeter and 96.5 centimeter.

9. A system according to claim 8 characterized in that the length of the diagonal of said wide viewing screen is approximately 86.3 centimeter.

10. A system according to claim 9 characterized in that said reciprocal of the throw distance ratio is substantially 0.92.

11. A system according to claim 1 characterized in that, for said widescreen picture tube, the centerscreen convergence angle is smaller than that of said narrowscreen picture tube, and the S-spacing of the outer electron beams at the tube reference line is greater than that of said narrowscreen picture tube.

12. A system according to claim 1 characterized in that said widescreen yoke has a pincushion-shaped horizontal deflection field that is significantly weaker than that of said narrowscreen yoke in accordance with said nonuniformity ratio, to avoid an underconvergence condition from existing at the extremes of the wide viewing screen major axis, that would otherwise have placed the crossover point of the outer electron beams substantially behind said wide viewing screen.

13. A system according to claim 12 characterized in that the S-spacing of the outer electron beams at the deflection plane in said widescreen picture tube is greater then that of said narrowscreen picture tube, thereby subjecting said outer electron beams to greater differential forces of a diverging nature produced by the electron beams passing through the pincushion-shaped horizontal deflection field of the widescreen yoke, as compared to the differential forces produced by the horizontal deflection field of the narrowscreen yoke.

14. A system according to claim 13 characterized in that the centerscreen convergence angle for said widescreen picture tube is smaller than that of said narrowscreen picture tube, thereby subjecting said outer electron beams to greater differential forces of a diverging nature produced by the electron beams passing through the pincushion-shaped horizontal deflection field of the widescreen yoke, as compared to the differential forces produced by the horizontal deflection field of the narrowscreen yoke.

15. A self converging widescreen color picture tube system, characterized by:

a widescreen, in-line color picture tube (30) having a funnel (29), an electron gun assembly (28) for three in-line electron beams located in a neck (31) at one end of said picture tube, and a faceplate (18) with a wide viewing screen (VSW) at the other end, said viewing screen having a wide aspect ratio, against a comparable narrowscreen, in-line color picture tube having a narrow viewing screen with an aspect ratio of approximately 1.33, where the two picture tubes have the same diagonal length, the same screen contour, and the same horizontal deflection angle as measured from their respective tube reference lines between extremes of their respective major axes;

a self converging widescreen deflection yoke (40) including horizontal (41) and vertical (42) deflection windings, said yoke being located by an initial flare section (32) of said funnel and positioned along the longitudinal axis of said widescreen picture tube to make the tube reference line thereof and the yoke deflection plane substantially coincident;

wherein to achieve substantial horizontal astigmatism correction at the extremes of the major axis of said wide viewing screen, said horizontal deflection winding is constructed to have a generally pincushion-shaped horizontal deflection field over the effective length of said field that is significantly weaker than that required of the horizontal deflection field in a comparable self converging narrowscreen yoke associated with said narrowscreen picture tube, to avoid an underconvergence condition from existing at the extremes of the major axis of said wide viewing screen that would otherwise have placed the crossover point of the outer electron beams substantially behind said wide viewing screen.

16. A system according to claim 15 characterized in that the spacing between the outer two of said three electron beams at the deflection plane in said widescreen picture tube is greater than that of said narrowscreen picture tube, thereby subjecting said outer electron beams to greater differential forces of a diverging nature produced by the electron beams passing through the pincushion-shaped horizontal deflection field of the widescreen yoke, as compared to the differential forces produced by the horizontal deflection field of the narrowscreen yoke.

17. A system according to claim 16 characterized in that the centerscreen convergence angle for said widescreen picture tube is smaller than that of said narrowscreen picture tube, thereby subjecting said outer electron beams to greater differential forces of a diverging nature produced by the electron beams passing through the pincushion-shaped horizontal deflection field of the widescreen yoke, as compared to the differential forces produced by the horizontal deflection field of the narrowscreen yoke.

18. A self converging widescreen color picture tube system, characterized by:

a widescreen, in-line color picture tube (30) having a funnel (29), an electron gun assembly (28) for three in-line electron beams located in a neck (31) at one end of said picture tube, and a faceplate (18) with a wide viewing screen (VSW) at the other end, said viewing screen having a wide aspect ratio $\alpha_W$, against a comparable narrowscreen in-line color picture tube having a narrow viewing screen with an aspect ratio of approximately 1.33, where the two picture tubes have the same diagonal length, the same screen contour, and the same horizontal deflection angle as measured from their respective tube reference lines between extremes of their respective major axes, but have differences in centerscreen slope angles and outer electron beam S-spacing at their respective tube reference lines;

a self converging widescreen deflection yoke (40) including horizontal (41) and vertical (42) deflection windings, said yoke being located by an initial flare section (32) of said funnel and positioned along the longitudinal axis of said widescreen picture tube to make the tube reference line thereof and the yoke deflection plane substantially coincident;

wherein to achieve substantial horizontal astigmatism correction at the extremes of the major axis of said wide viewing screen, said horizontal deflection winding is constructed to have a generally pincushion-shaped horizontal deflection field over the effective length of said field that is modified from that required of the horizontal deflection field in a comparable self converging narrowscreen yoke associated with said narrowscreen picture tube, the modification being in accordance with said differences in centerscreen slope angles and outer electron beam S-spacing at their respective tube reference lines, to avoid a misconvergence condition from existing at the extremes of the major axis of said wide viewing screen that would otherwise have placed the crossover point of the outer electron beams substantially removed from the surface of said wide viewing screen.

19. A system according to claim 18 characterized in that said wide aspect ratio is substantantially between the range of 1.67 and 2.0.

20. A system according to claim 18 characterized in that said wide aspect ratio is about 1.78, and where said horizontal defection angle is about 96°, resulting thereby in a widescreen tube deflection angle of about 106°, as measured from the tube reference line between extremes of the viewing screen diagonal.

21. A system according to claim 14 characterized in that said wide viewing screen has a large diagonal length substantially between 66 centimeter and 96.5 centimeter.

22. A system according to claim 21 characterized in that the length of the diagonal of said wide viewing screen is approximately 86.3 centimeter.

23. A system according to claim 21 characterized in that said wide aspect ratio is about 1.78, and where said horizontal defection angle is about 96°, resulting thereby in a widescreen tube deflection angle of about 106°, as measured from the tube reference line between extremes of the viewing screen diagonal.

24. A self converging widescreen color picture tube system, characterized by:

a widescreen, in-line color picture tube (30) having a funnel (29), an electron gun assembly (28) for three in-line electron beams located in a neck at one end of said picture tube, and a faceplate (18) with a wide viewing screen (VSW) at the other end, said viewing screen having a wide aspect ratio, $\alpha$W against a comparable narrowscreen, in-line color picture tube having a narrow viewing screen with an aspect ratio $\alpha_N$ of approximately 1.33, where the two picture tubes have the same diagonal length, the same screen contour, and the same horizontal deflection angle as measured from their respective tube reference lines between extremes of their respective major axes;

a self converging widescreen deflection yoke (40) including horizontal (41) and vertical (42) deflection windings, said yoke being located by an initial flare section (32) of said funnel and positioned along the longitudinal axis of said widescreen picture tube to make the tube reference line thereof and the yoke deflection plane substantially coincident;

wherein to achieve substantial horizontal astigmatism correction at the extremes of the major axis of said wide viewing screen, said horizontal deflection winding is constructed to have a horizontal deflection field that exhibits a third harmonic component that results in an effective H2 field distribution function for said yoke which satisfies a requirement that a nonuniformity ratio H2R be substantially equal to $$\sqrt{[1 + \alpha_W^{-2}]/[1 + \alpha_N^{-2}]},$$

where the nonuniformity ratio H2R is the ratio of the effective H2 field distribution function of the horizontal deflection field for said widescreen yoke to the effective H2 field distribution function of the horizontal deflection field for a comparable narrowscreen self converging yoke associated with said narrowscreen picture tube.

25. A system according to claim 24 characterized in that said wide aspect ratio is substantantially between the range of 1.67 and 2.0.

26. A system according to claim 25 characterized in that said wide aspect ratio is about 1.78, resulting in said H2 ratio being substantially equal to 0.92.

* * * * *